US007194847B2

(12) United States Patent
Summons et al.

(10) Patent No.: US 7,194,847 B2
(45) Date of Patent: Mar. 27, 2007

(54) METHOD OF FILLING DISPENSING CARTRIDGES HAVING COLLAPSIBLE PACKAGES

(75) Inventors: Elliot Summons, Centennial, CO (US); Wayne Summons, Thornton, CO (US)

(73) Assignee: Sashco, Inc., Brighton, CO (US)

( * ) Notice: Subject to any disclaimer, the term of this patent is extended or adjusted under 35 U.S.C. 154(b) by 298 days.

(21) Appl. No.: 10/996,397

(22) Filed: Nov. 23, 2004

(65) Prior Publication Data

US 2005/0198927 A1 Sep. 15, 2005

Related U.S. Application Data

(60) Continuation-in-part of application No. 10/183,107, filed on Jun. 26, 2002, now abandoned, which is a division of application No. 09/908,420, filed on Jul. 18, 2001, now Pat. No. 6,464,112, which is a continuation-in-part of application No. 09/391,798, filed on Sep. 9, 1999, now abandoned.

(51) Int. Cl.
*B65B 3/04* (2006.01)
*B65B 31/64* (2006.01)

(52) U.S. Cl. ..... 53/433; 53/459; 53/511; 141/10

(58) Field of Classification Search ..... 53/403, 53/408, 432, 433, 459, 84, 511, 510, 574; 141/10, 65, 316
See application file for complete search history.

(56) References Cited

U.S. PATENT DOCUMENTS

| | | | | |
|---|---|---|---|---|
| 1,698,404 A | | 1/1929 | Hopkins | |
| 1,965,271 A | | 7/1934 | Wharton | |
| 2,433,347 A | * | 12/1947 | Deakin | 341/30 |
| 2,722,218 A | | 11/1955 | Mittleman | |
| 2,833,444 A | | 5/1958 | Sherbondy | |
| 3,029,983 A | | 4/1962 | Wagenhals | |
| 3,092,939 A | | 6/1963 | Wiley et al. | |
| 3,105,615 A | | 10/1963 | Koga | |
| 3,159,312 A | | 12/1964 | Sciver | |
| 3,197,071 A | | 7/1965 | Kuster | |
| 3,206,074 A | | 9/1965 | Hoffmann | |
| 3,224,158 A | * | 12/1965 | Baumann | 53/432 |
| 3,266,671 A | | 8/1966 | Gelpey | |
| 3,302,832 A | | 2/1967 | Hardman | |
| 3,323,682 A | | 6/1967 | Creighton, Jr. et al. | |
| 3,409,710 A | | 11/1968 | Klygis | |
| 3,455,348 A | * | 7/1969 | De Cat et al. | 141/65 |
| 3,791,098 A | | 2/1974 | Webster | |
| 3,813,011 A | | 5/1974 | Harrison | |
| 3,897,672 A | * | 8/1975 | Scheindel | 53/470 |
| 3,948,704 A | | 4/1976 | Evans | |

(Continued)

FOREIGN PATENT DOCUMENTS

JP 04311472 11/1992

OTHER PUBLICATIONS

Statomix Motionless Mixers brochure, Jun. 1997, ConPro Tec, Inc. (admitted prior art).

(Continued)

*Primary Examiner*—Stephen F. Gerrity
*Assistant Examiner*—Paul Durand
(74) *Attorney, Agent, or Firm*—Holland & Hart

(57) ABSTRACT

A method of filling a collapsible package in a cartridge for use with a caulking gun is provided. The method comprises pressurizing an internal space of a collapsible package to expand the package. Drawing a vacuum external to the collapsible package and removing the positive internal pressure. The vacuum maintains the package in an expanded state. A nozzle is then inserted into the collapsible package to reverse fill the package with a vicious material.

15 Claims, 32 Drawing Sheets

U.S. PATENT DOCUMENTS 3,976,223 A 8/1976 Jass et al.
3,993,224 A 11/1976 Harrison
4,014,463 A 3/1977 Hermann
4,147,282 A 4/1979 Levy
4,240,566 A 12/1980 Bergman
4,277,184 A 7/1981 Solomon
4,340,154 A 7/1982 VanManen
4,350,272 A * 9/1982 Petterson ..... 222/386.5
4,366,919 A 1/1983 Anderson
4,370,062 A 1/1983 Moody
4,386,717 A 6/1983 Koob
4,432,469 A 2/1984 Eble
4,493,436 A 1/1985 Brokaw
4,711,373 A 12/1987 Christine
4,738,379 A 4/1988 Takasugi
4,747,517 A 5/1988 Hart
4,753,536 A 6/1988 Spehar et al.
4,767,025 A 8/1988 Gebauer
4,817,687 A * 4/1989 Lofgren et al. ..... 141/65
4,846,373 A 7/1989 Penn
4,901,888 A 2/1990 Standlick
4,913,316 A 4/1990 Richter
4,926,029 A 5/1990 Pearson
4,974,756 A 12/1990 Pearson
4,981,238 A * 1/1991 Wenmaekers ..... 222/103
4,981,241 A 1/1991 Keller
4,989,758 A 2/1991 Keller
4,995,540 A 2/1991 Colin et al.
5,004,125 A 4/1991 Standlick
5,033,650 A 7/1991 Colin et al.
5,065,906 A 11/1991 Meader
5,069,365 A 12/1991 Woodhouse
5,114,044 A 5/1992 Spanek, Jr.
RE33,969 E 6/1992 Richter
5,161,715 A 11/1992 Giannuzzi
5,170,609 A * 12/1992 Bullock et al. ..... 53/434
5,184,757 A 2/1993 Ginnuzzi
5,197,961 A 3/1993 Castle
5,203,839 A 4/1993 Skaggs
5,236,108 A 8/1993 House
5,242,082 A 9/1993 Giannuzzi
5,249,709 A 10/1993 Duckworth
5,301,842 A 4/1994 Ritter
5,307,954 A 5/1994 Gick et al.
5,375,740 A 12/1994 Umetsu
5,386,928 A 2/1995 Blette
5,401,169 A 3/1995 Fleisher
5,405,090 A 4/1995 Greene
5,413,253 A 5/1995 Simmen
5,443,181 A 8/1995 Popp
5,477,664 A 12/1995 Carroll
5,494,190 A 2/1996 Boettcher
5,505,039 A * 4/1996 Maier ..... 53/432
5,535,922 A 7/1996 Maziarez
5,566,860 A 10/1996 Schlitz et al.
5,593,066 A 1/1997 Konuma
5,609,271 A 3/1997 Keller
5,647,510 A 7/1997 Keller
5,650,180 A 7/1997 Kumada
5,676,280 A 10/1997 Robinson
5,699,935 A 12/1997 Stahley
5,791,123 A 8/1998 Bolz
5,799,469 A * 9/1998 Obrist ..... 53/470
5,823,391 A 10/1998 Klauke et al.
5,826,751 A 10/1998 Stahley
5,842,604 A 12/1998 Stahley
5,860,565 A 1/1999 Winston et al.
5,862,951 A 1/1999 Gruenbacher
5,865,345 A 2/1999 Cistone et al.
5,873,970 A 2/1999 Konuma
5,897,028 A 4/1999 Sauer
5,918,770 A 7/1999 Cramm et al.
5,921,440 A 7/1999 Maines
5,954,231 A 9/1999 Durliat et al.
6,019,251 A 2/2000 Koga
6,047,861 A 4/2000 Vidal et al.
6,062,430 A * 5/2000 Fuchs ..... 222/105
6,141,941 A 11/2000 Carroll

OTHER PUBLICATIONS

Suizer Quadro "The Disposable Mixer" catalog, Sulzer Chemtech (admitted prior art).
Two Component Mix Gun advertising flyer, Copyright 1992, Jesco Products Co., Inc. (admitted prior art).
Semco Product Catalog (admitted prior art).
John W. Blair Co. product catalog (admitted prior art).
Sashco "Big Stretch" advertising flyer (admitted prior art).
Sascho "Lexel" advertising flyer (admitted prior art).
Sashco "Log Builder" advertising flyer (admitted prior art).
Sashco "Log Jam" advertising flyer (admitted prior art).
Sashco "Capture" advertising flyer (admitted prior art).
Sashco "Pennetreat" advertising flyer (admitted prior art).
Sashco "High Sierra Log Stain" advertising flyer (admitted prior art).
Sashco "It's Finally Built But It's Not Finished" advertising flyer (admitted prior art).
Sashco "Step-by-Step Instructions" advertising flyer (admitted prior art).
Sashco "Symphony" advertising flyer (admitted prior art).
Sashco "Through the Roof" advertising flyer (admitted prior art).

* cited by examiner

Fig.7-A
Prior Art
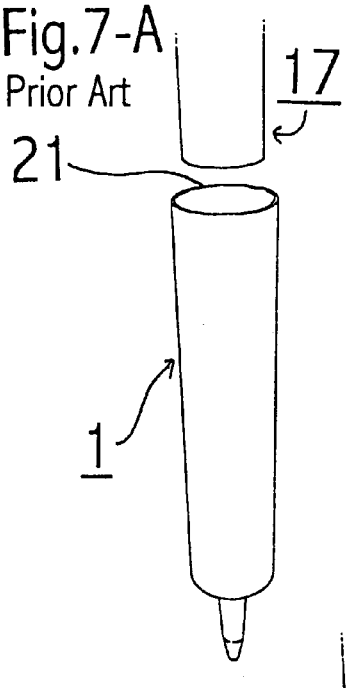
Fig.7-B
Prior Art
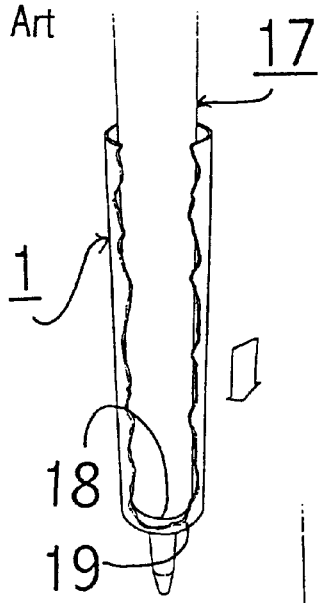
Fig.7-C
Prior Art
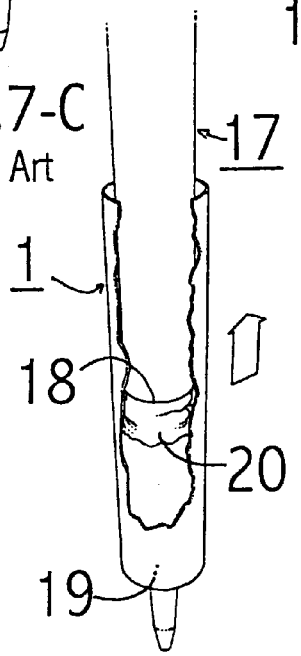
Fig.7-D
Prior Art
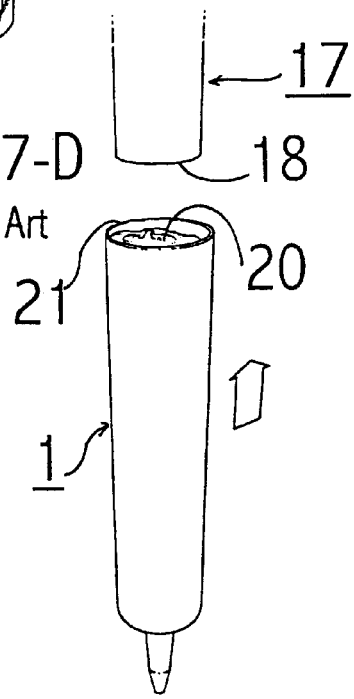

Fig.8-A
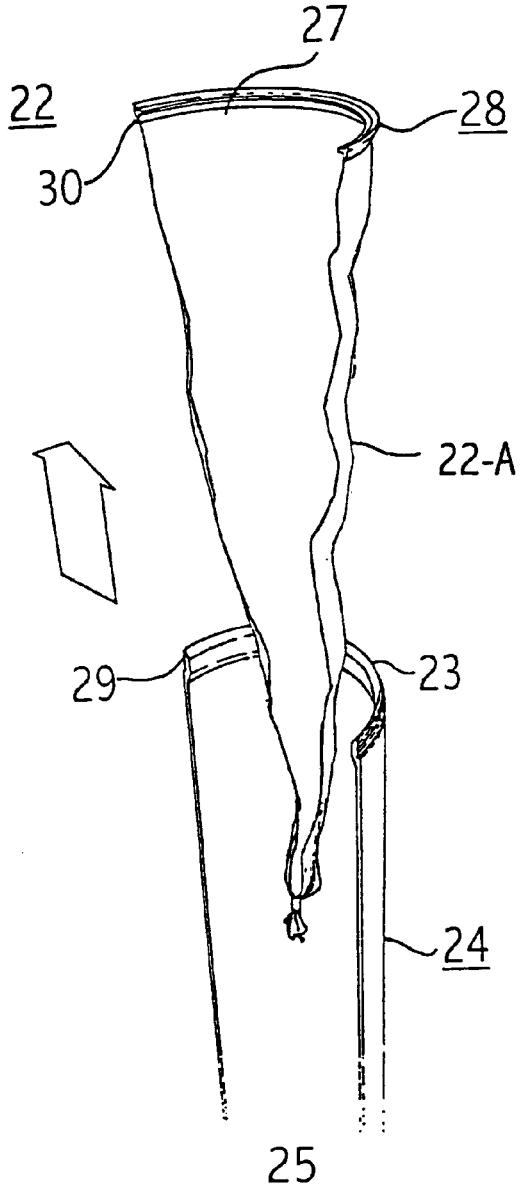
Fig.8-B
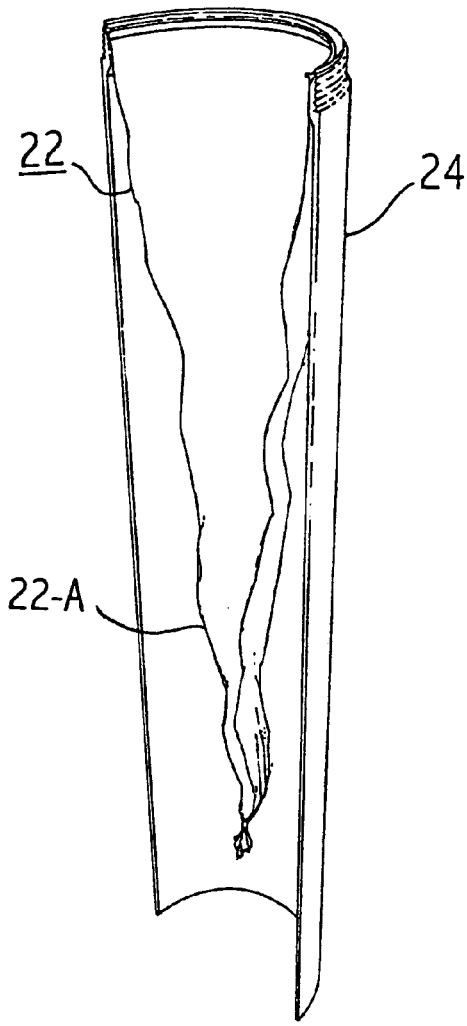

Fig.8-C
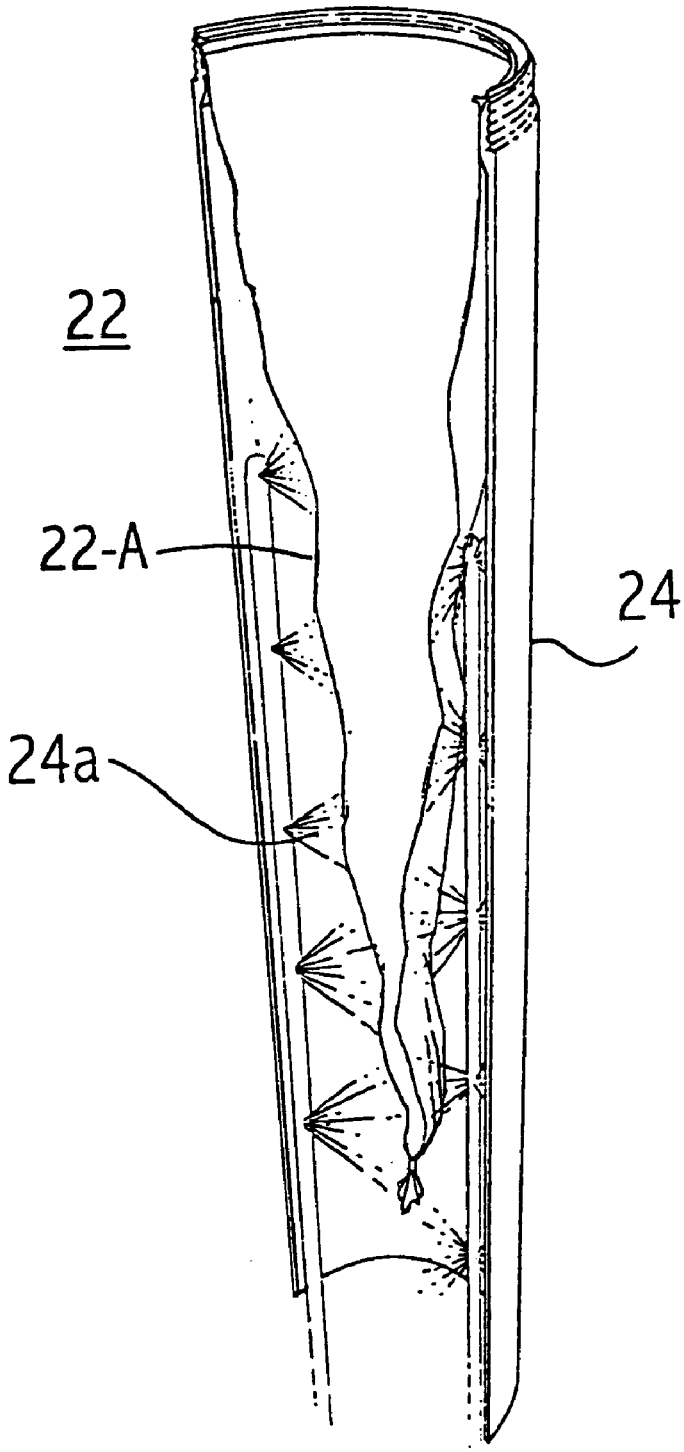

Fig.8-D
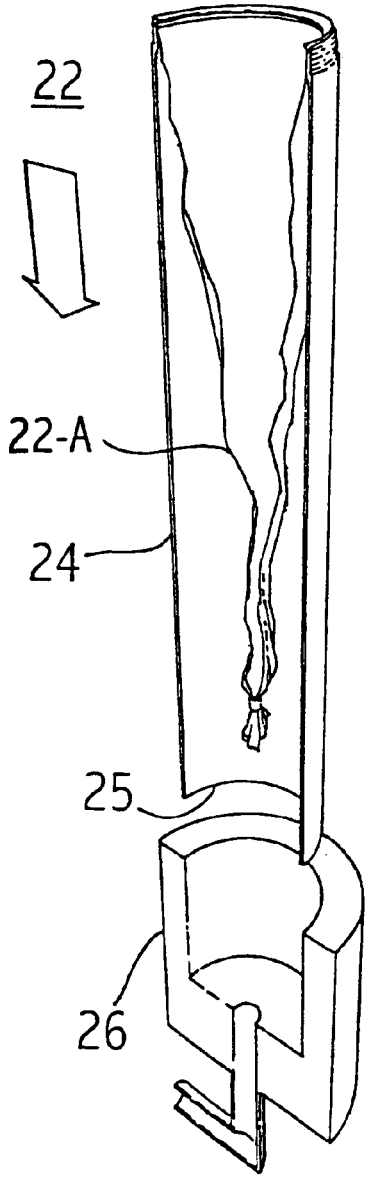
Fig.8-E
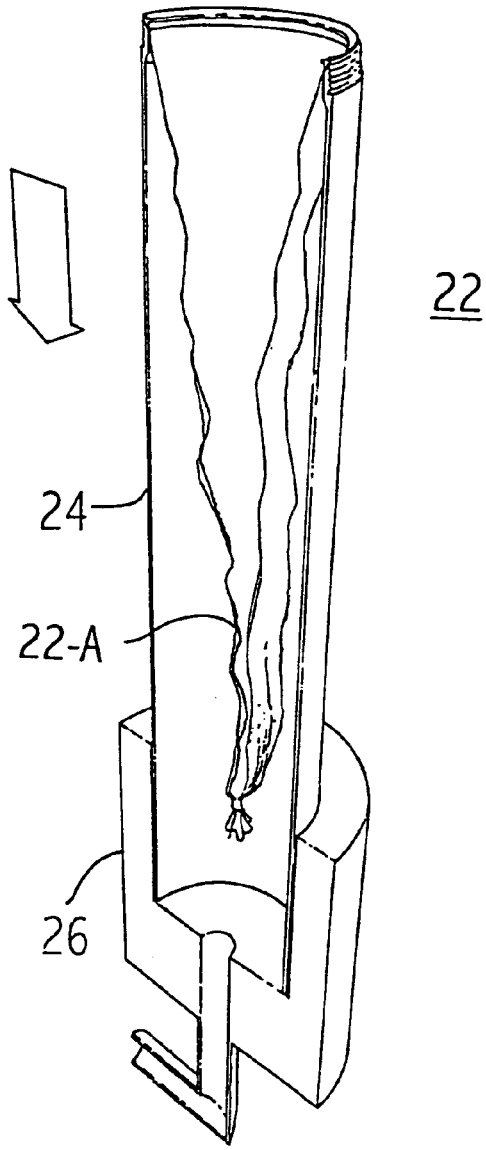

Fig.8-F
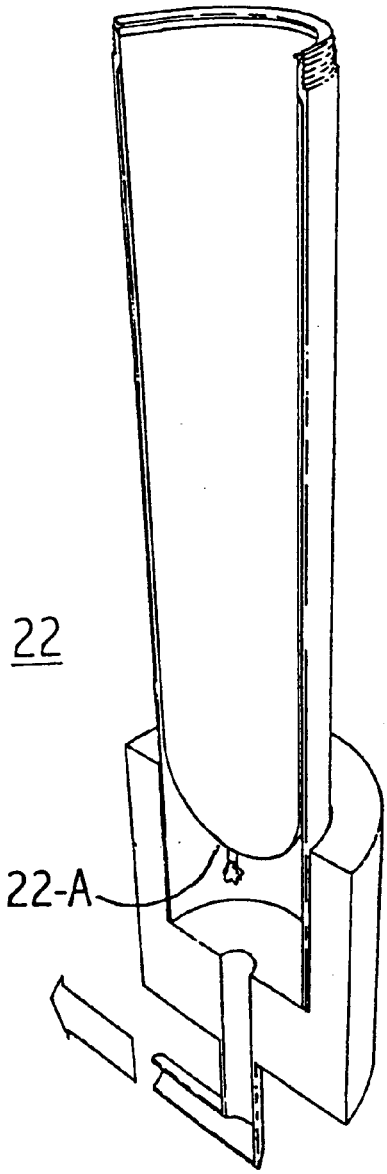
Fig.8-G
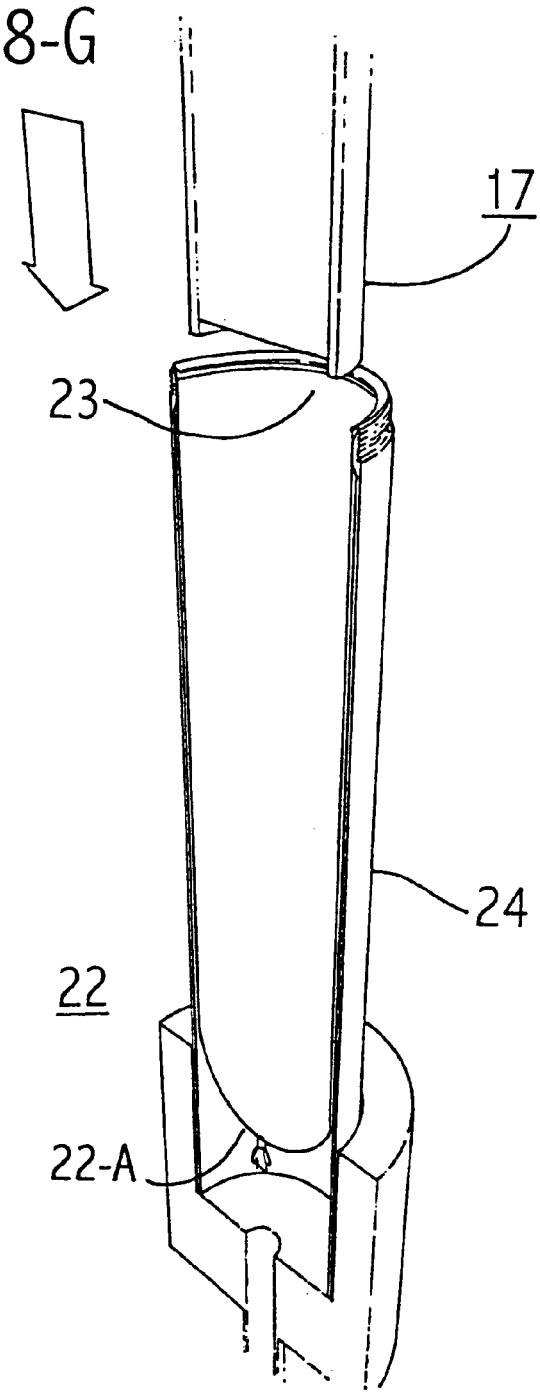

Fig.8-H
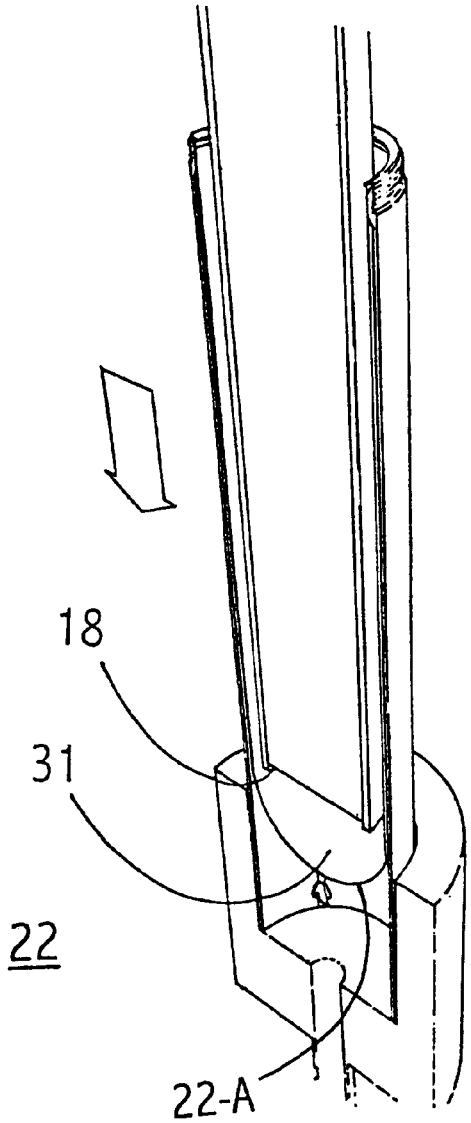
Fig.8-I
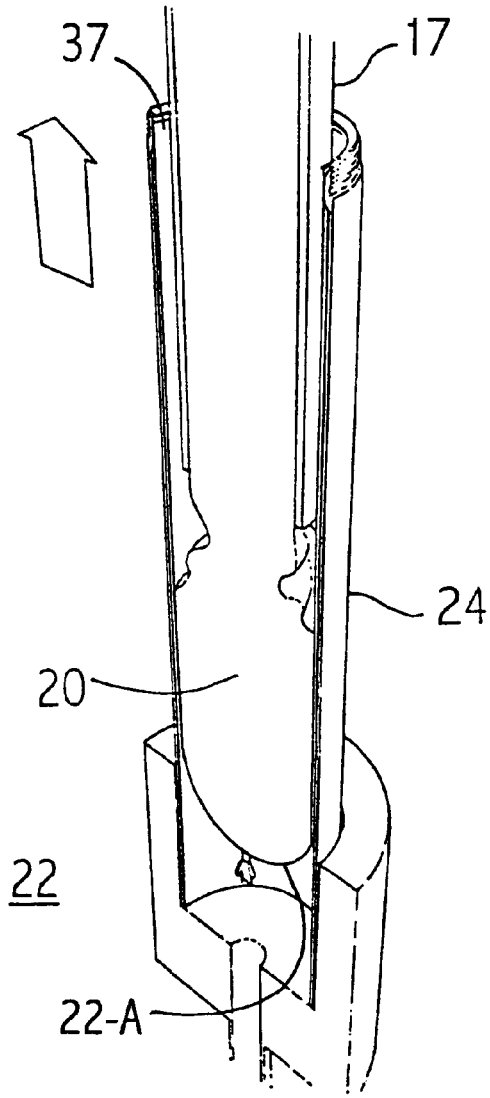

Fig.8-J
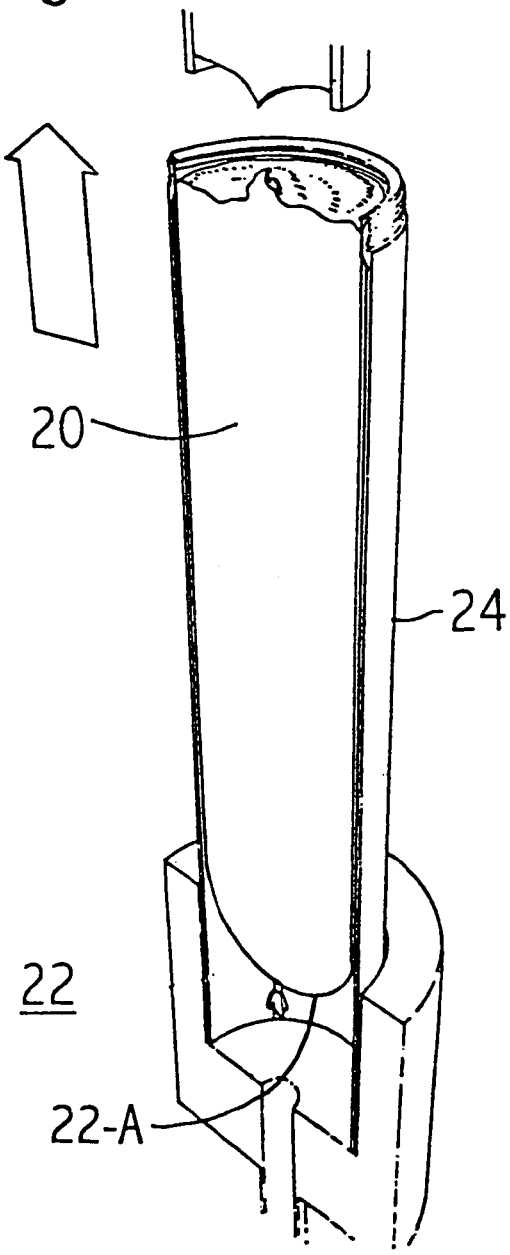
Fig.8-K
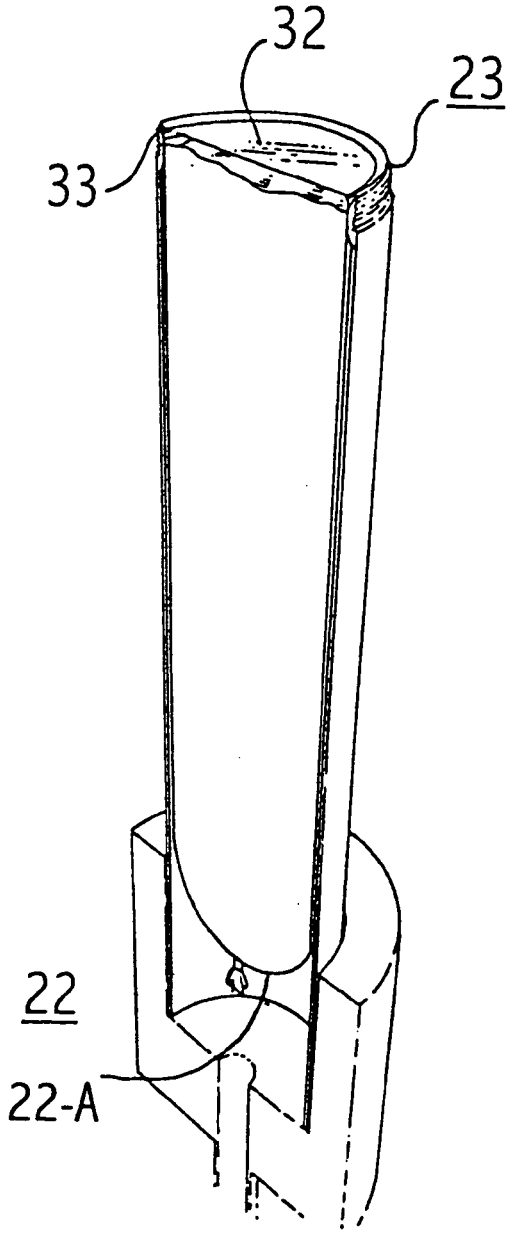

Fig.8-L
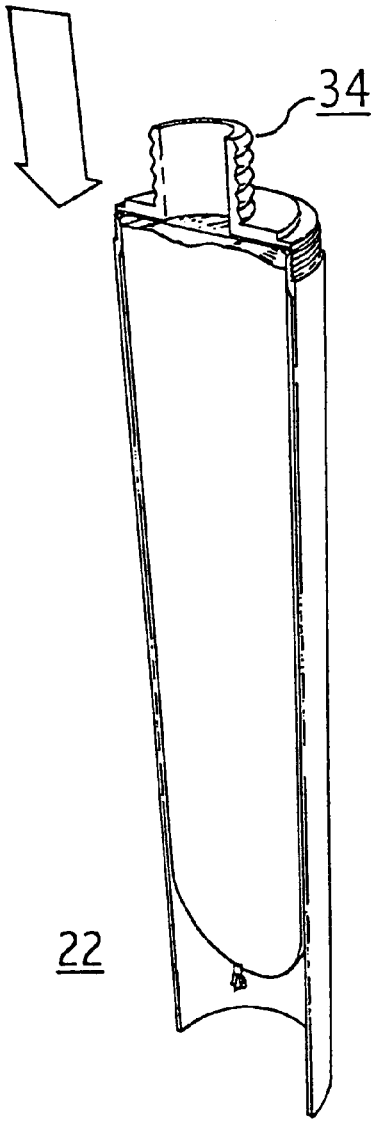
Fig.8-M
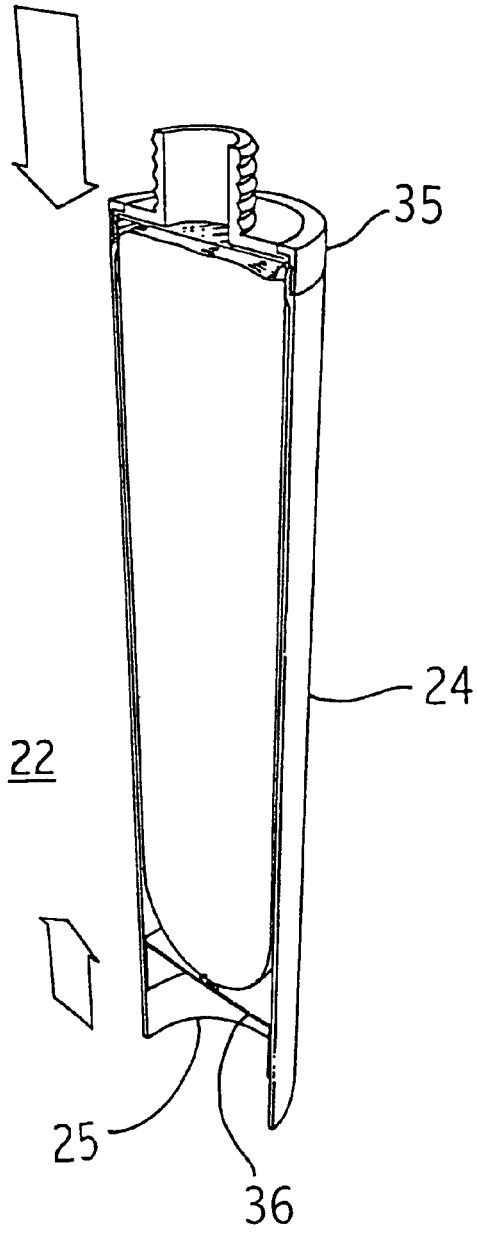

Fig.9-A
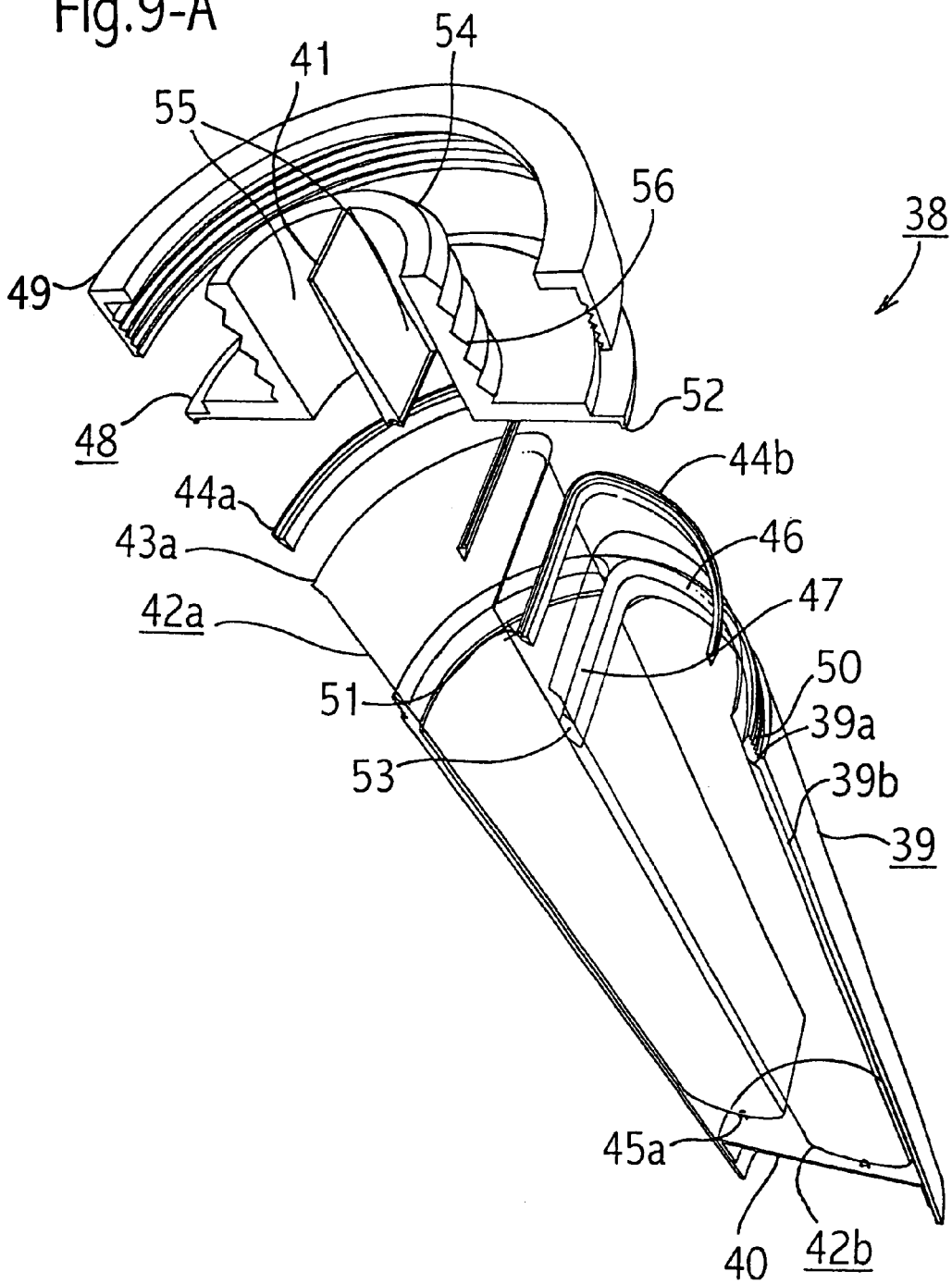

Fig.9-B
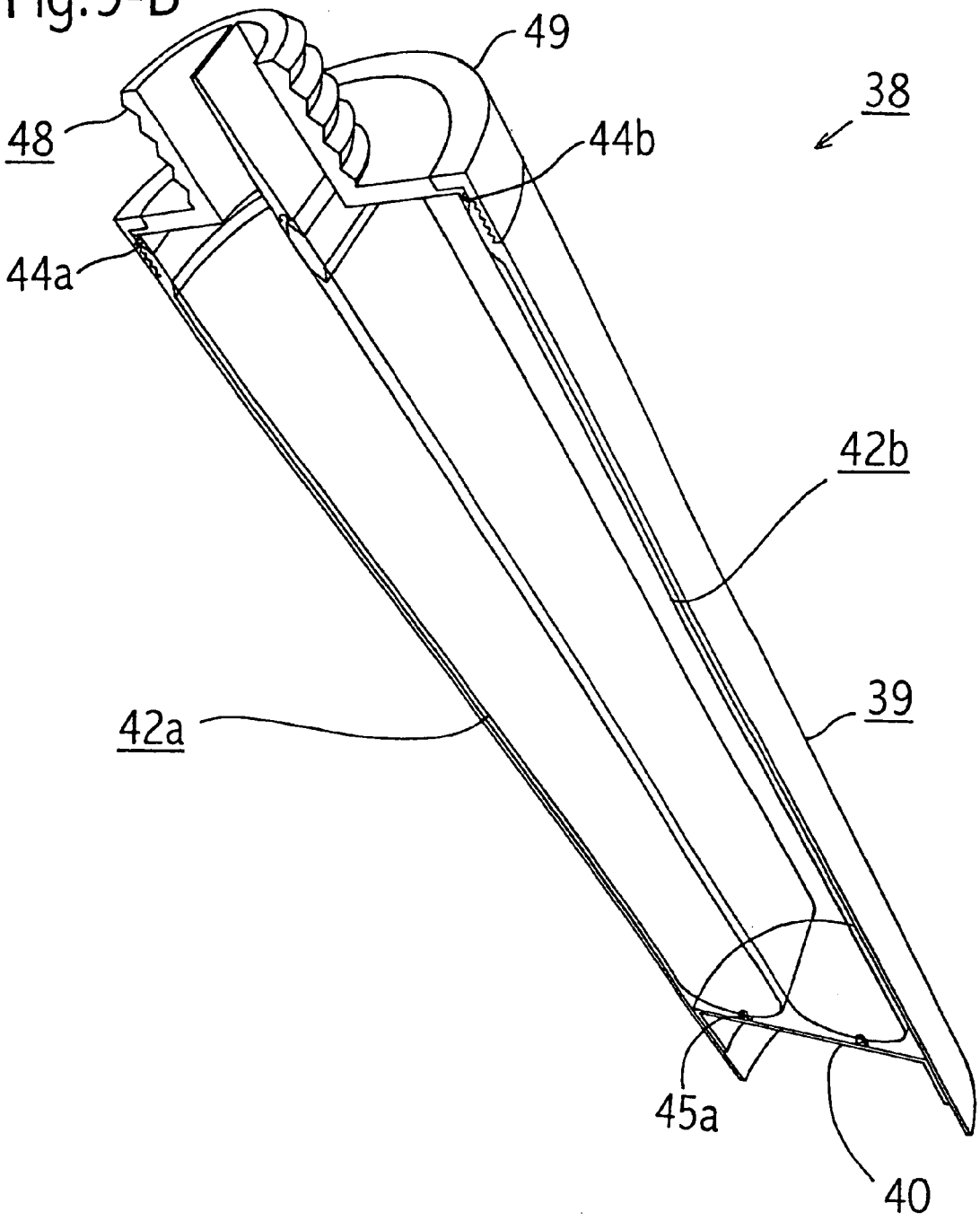

Fig.10-A
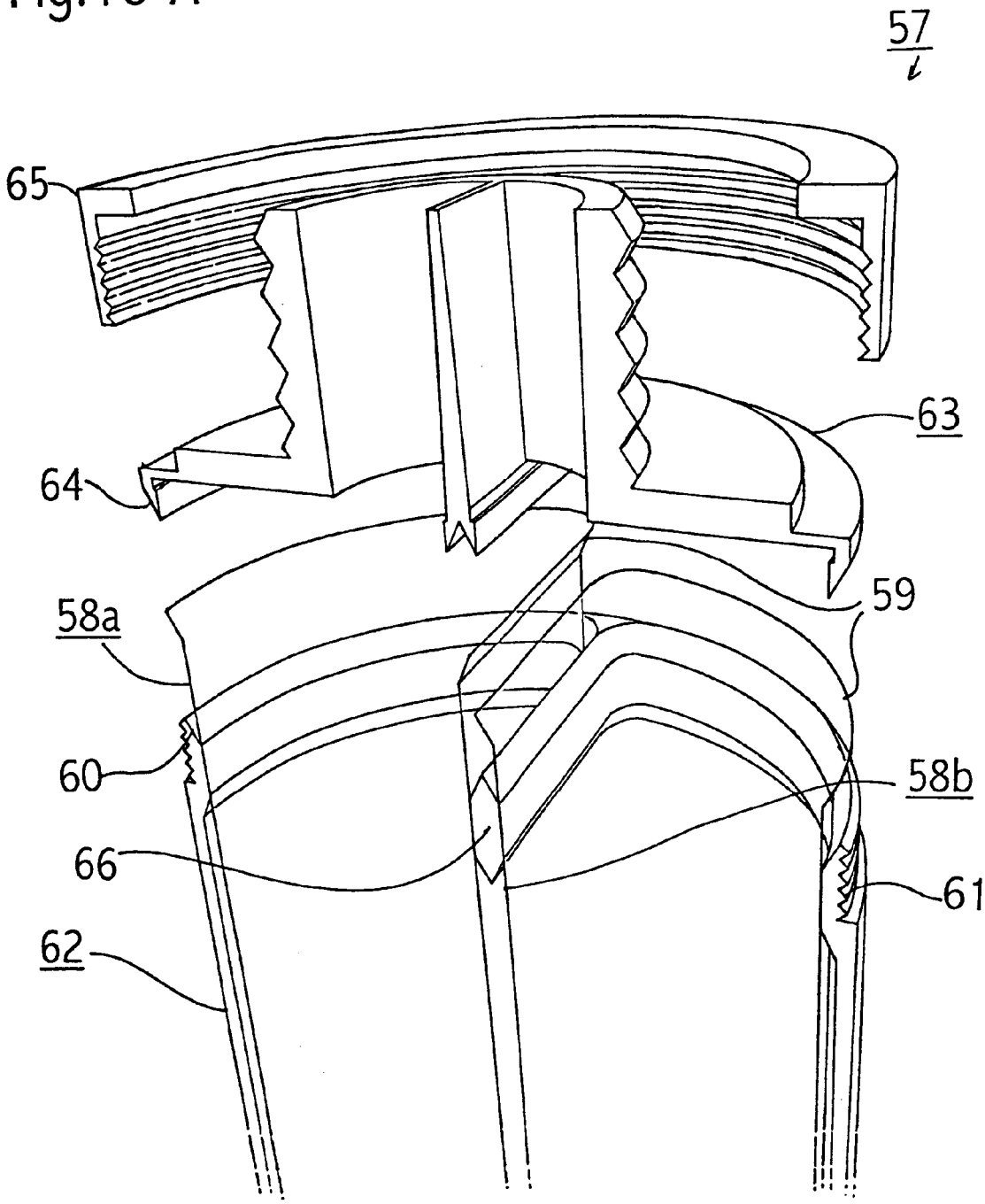

Fig.10-B
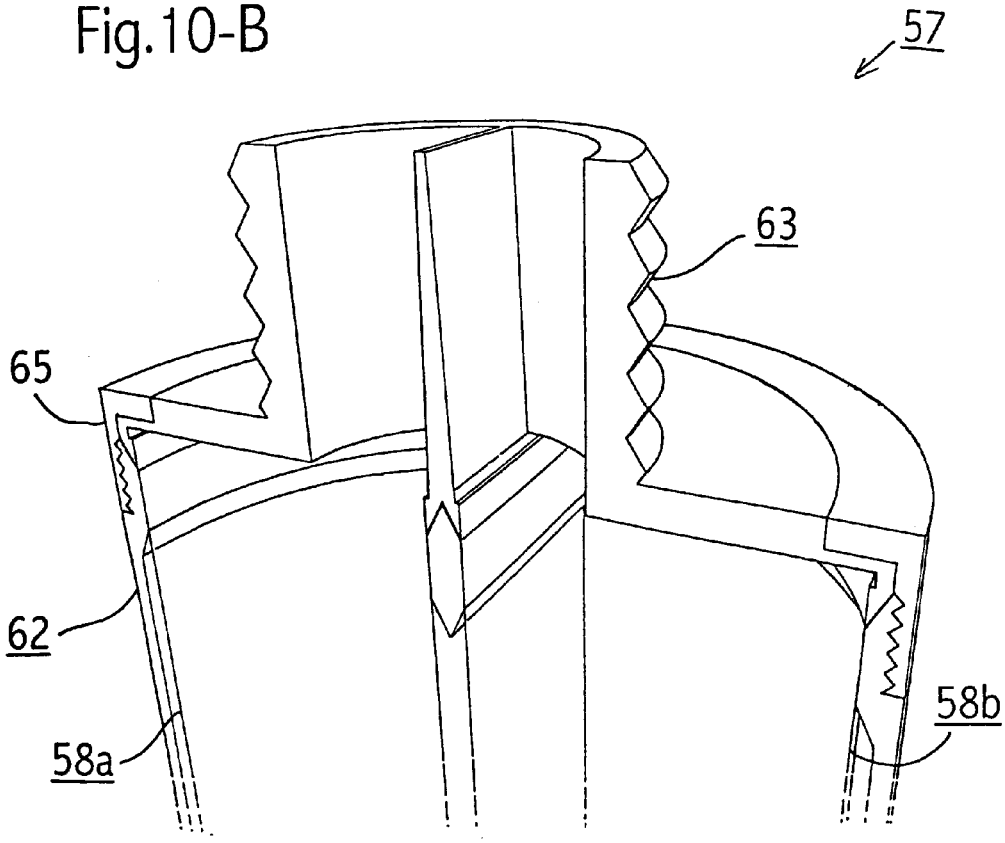

Fig.11-A
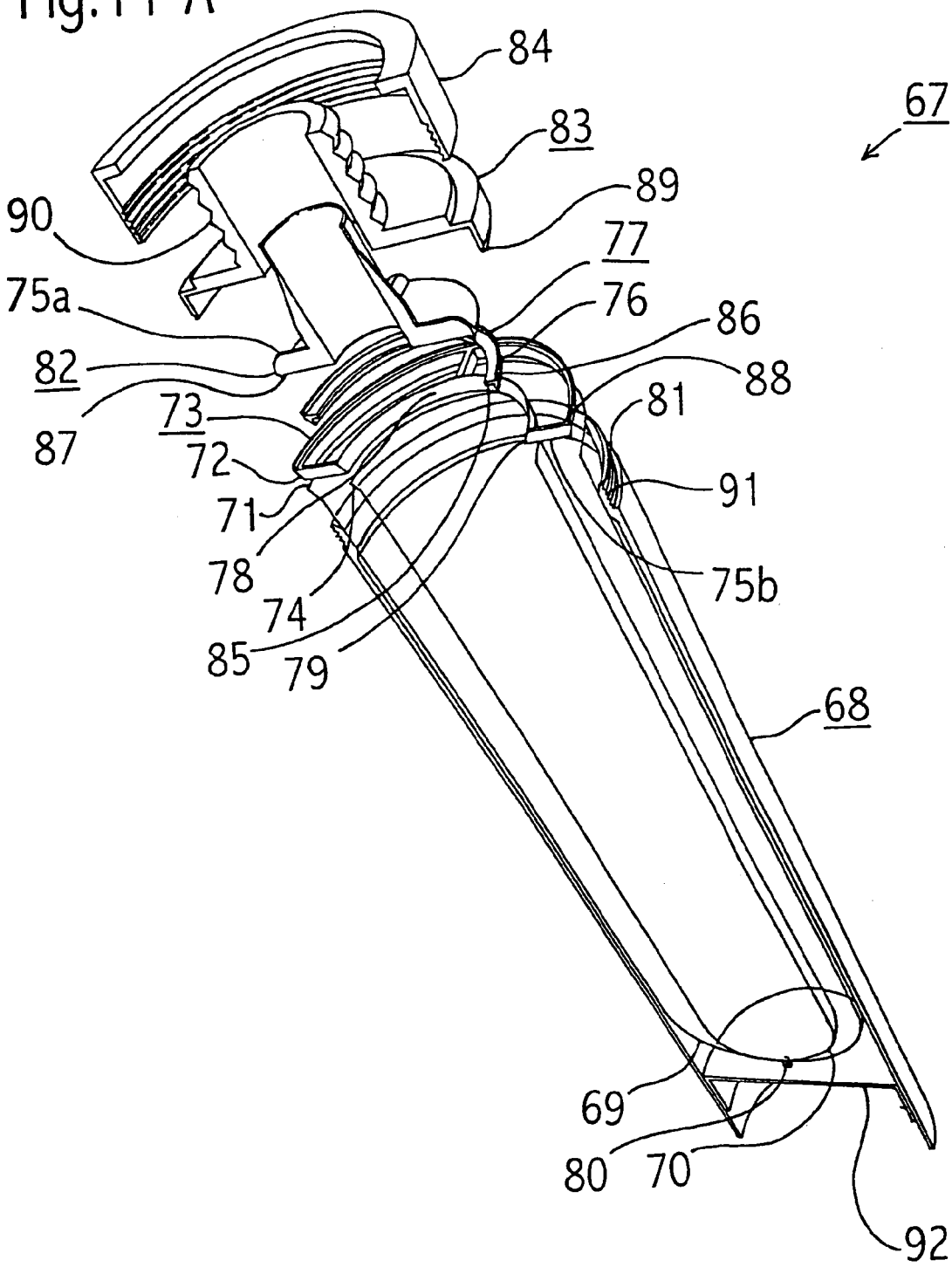

Fig.11-B
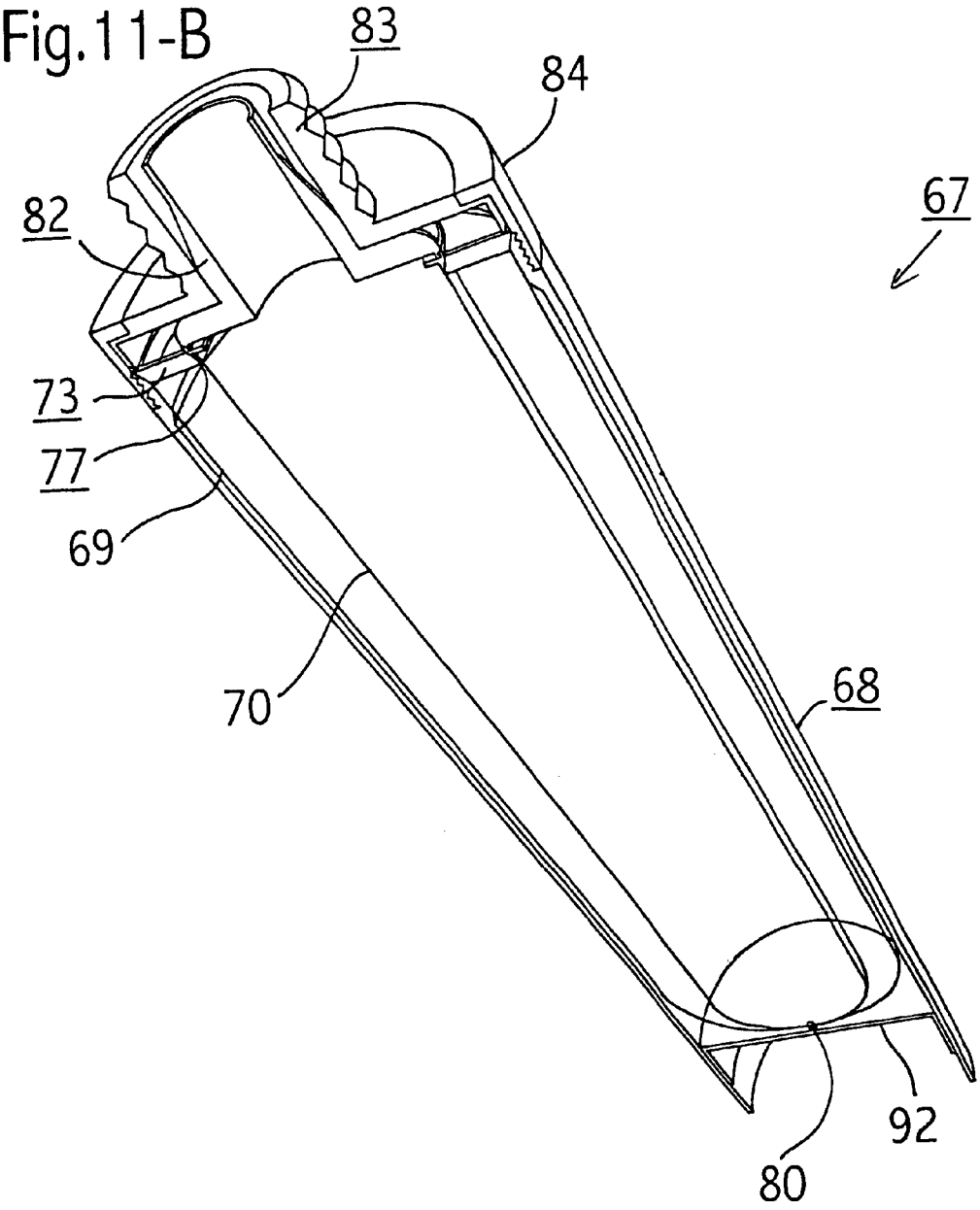

Fig.11-C
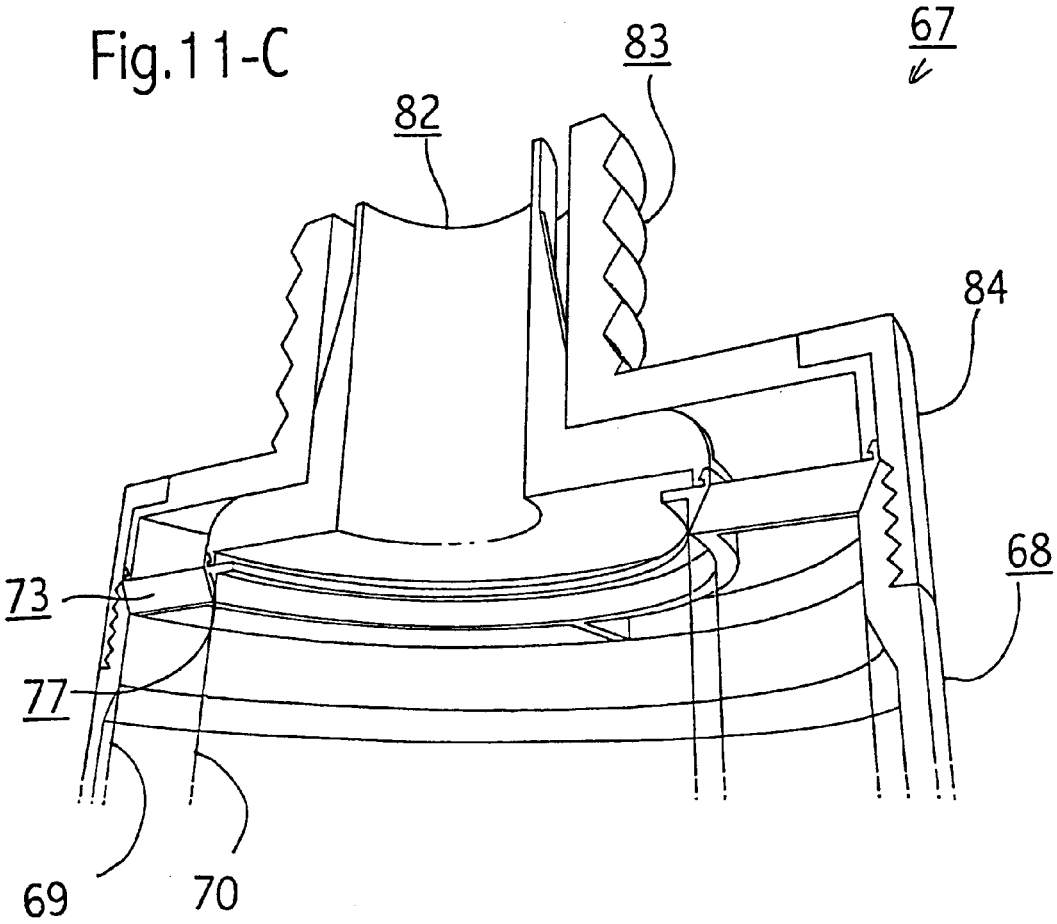

Fig.12-A
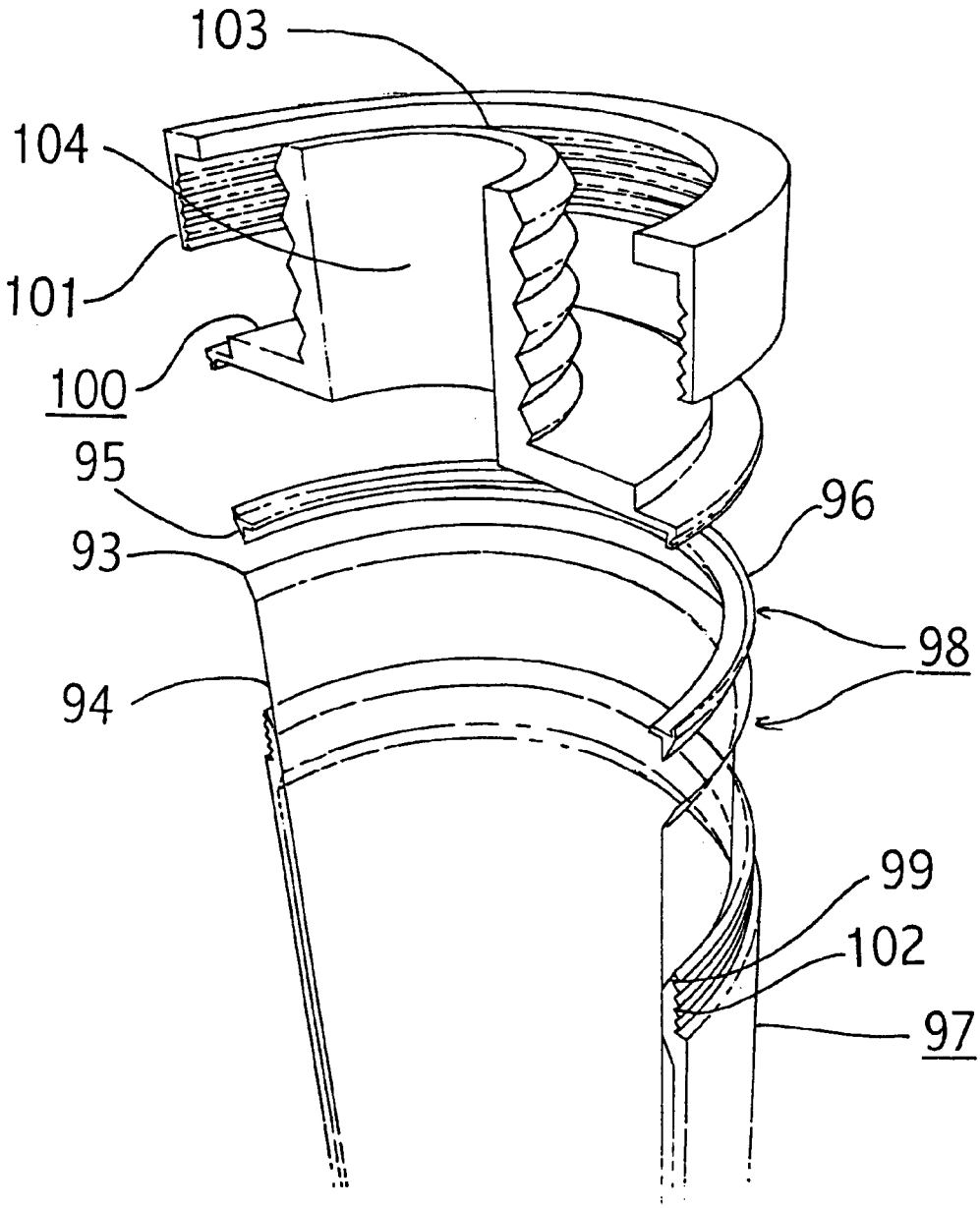

Fig.12-B
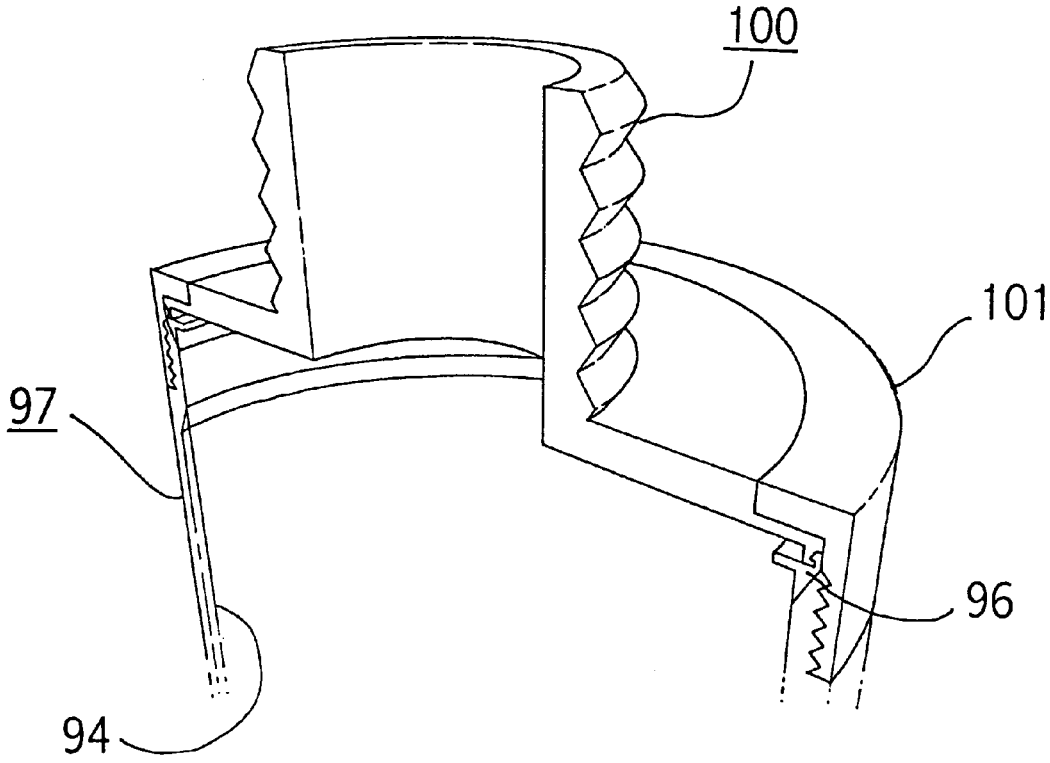

Fig. 13-A
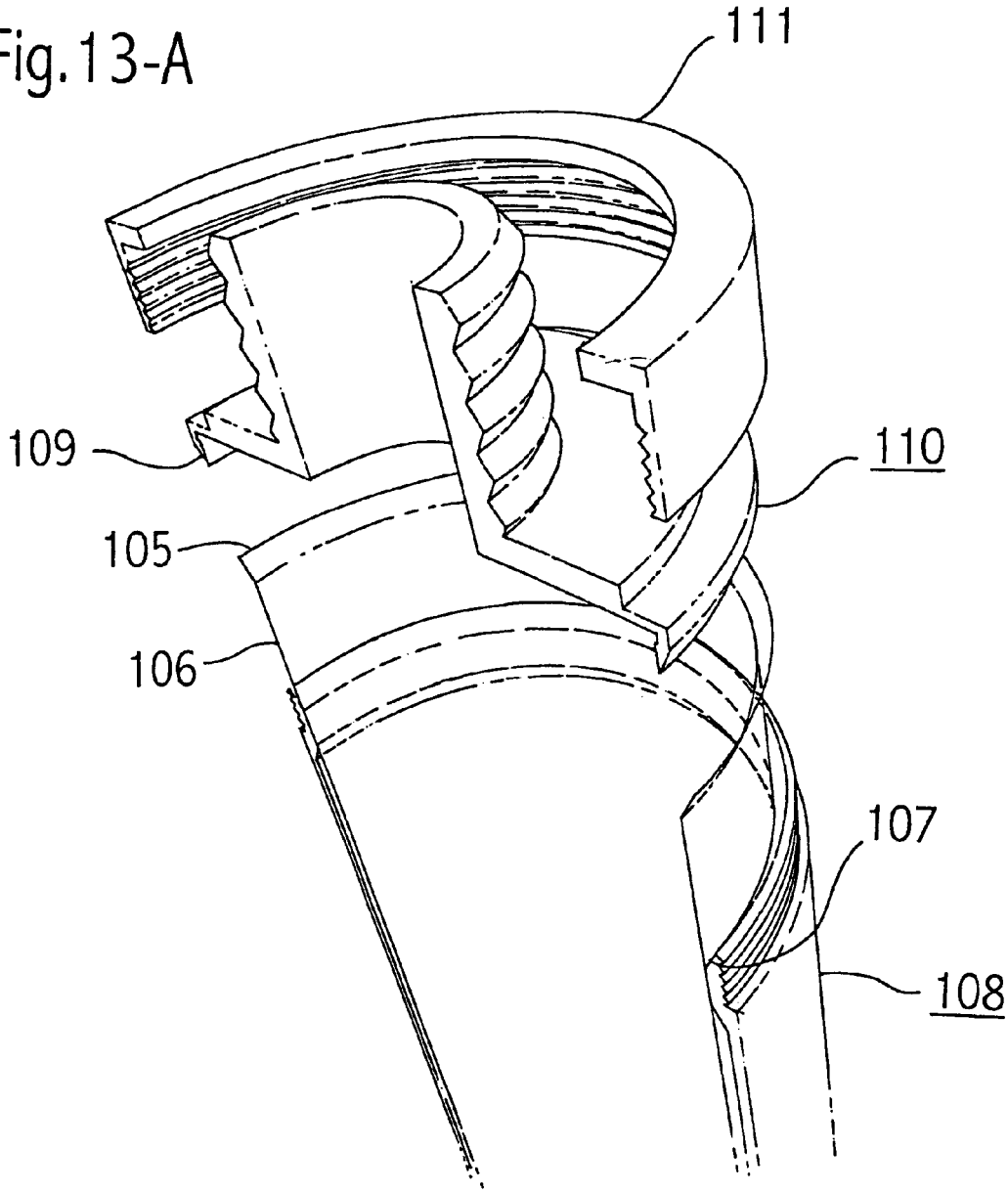

Fig.13-B
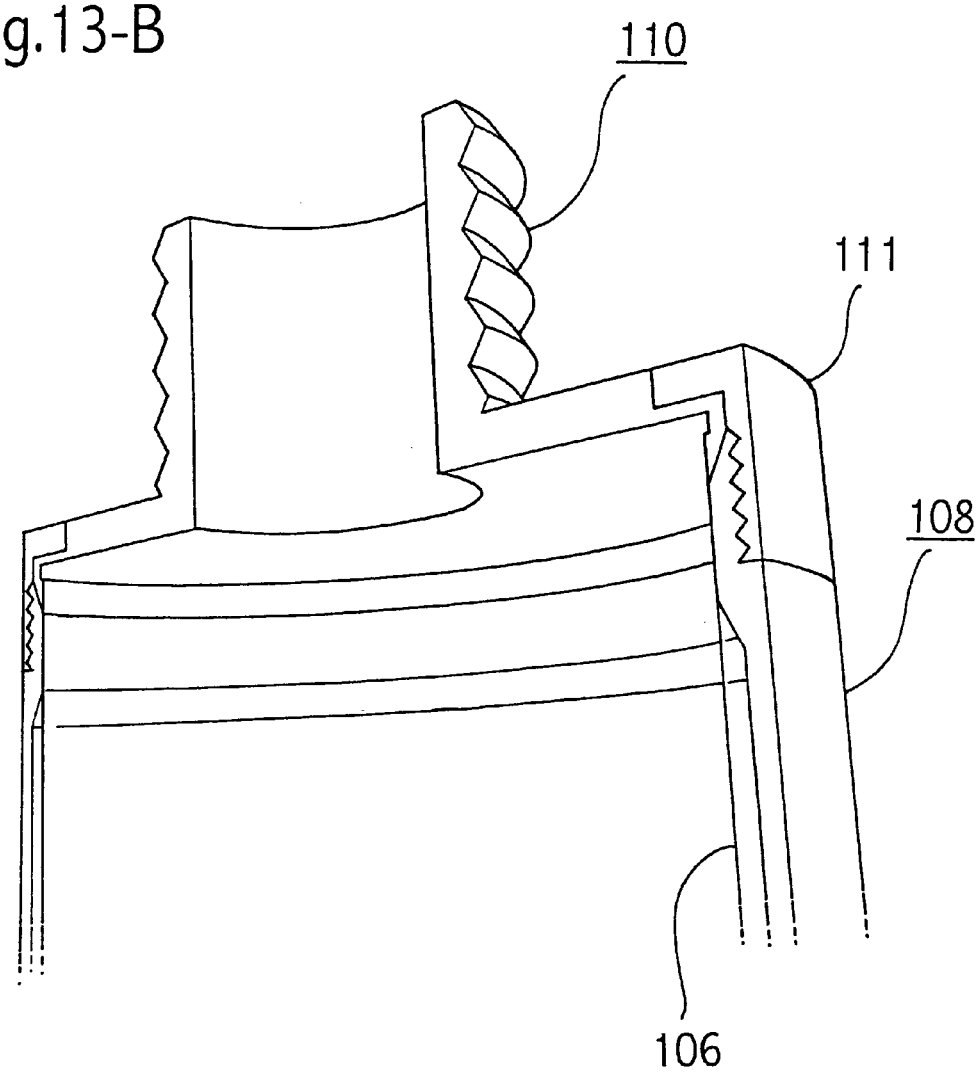

Fig.16-A
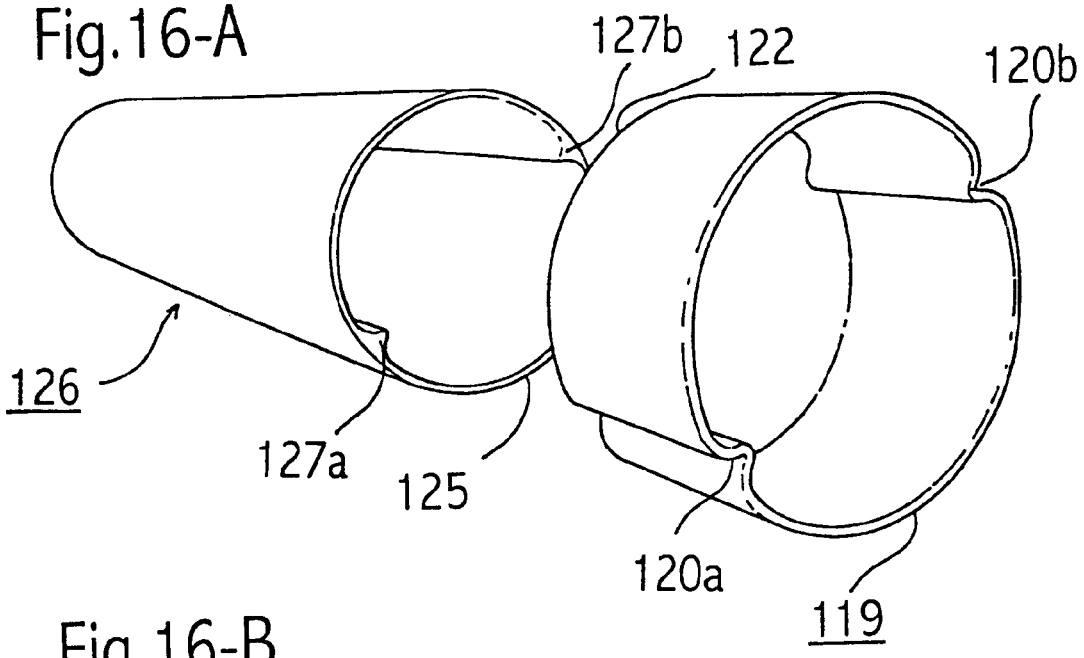
Fig.16-B
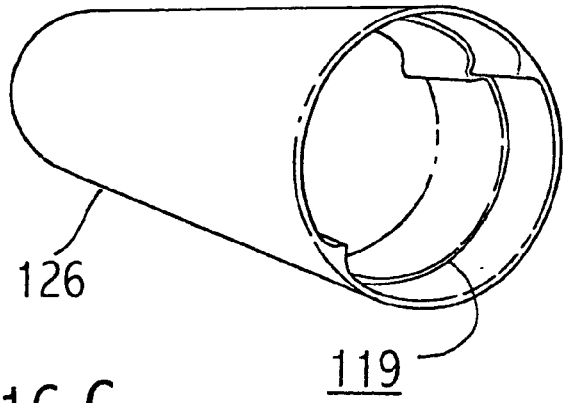
Fig.16-C
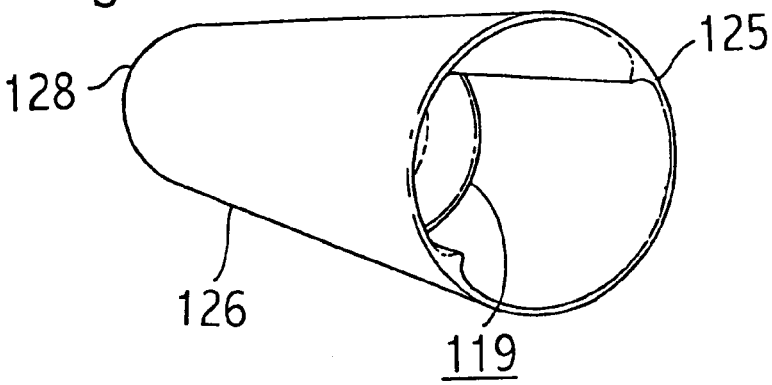

Fig.18-A
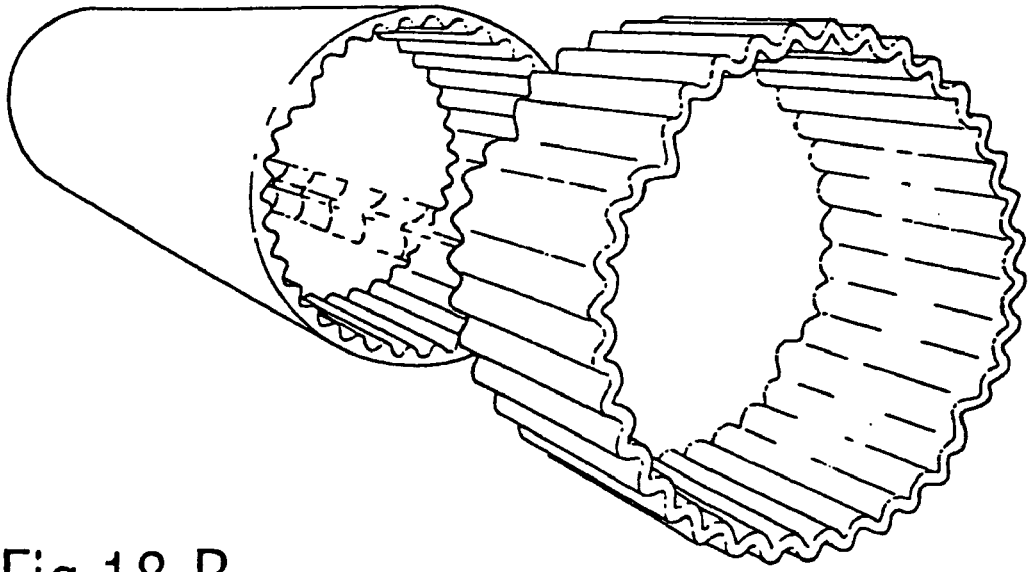
Fig.18-B
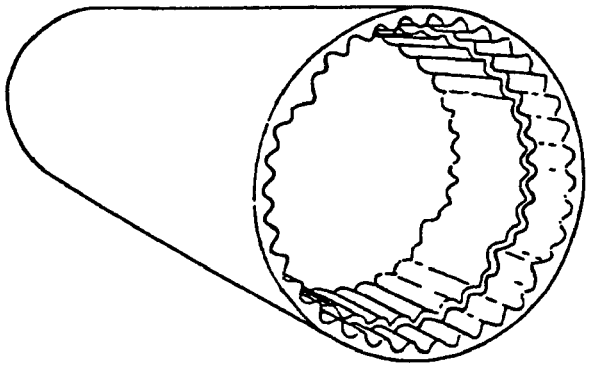
Fig.18-C
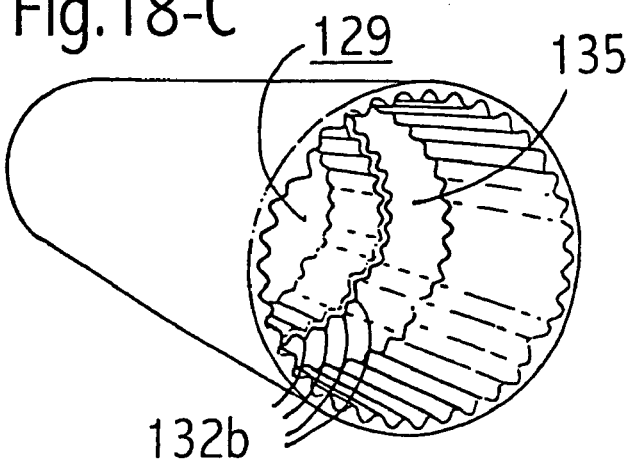

Fig.19-A
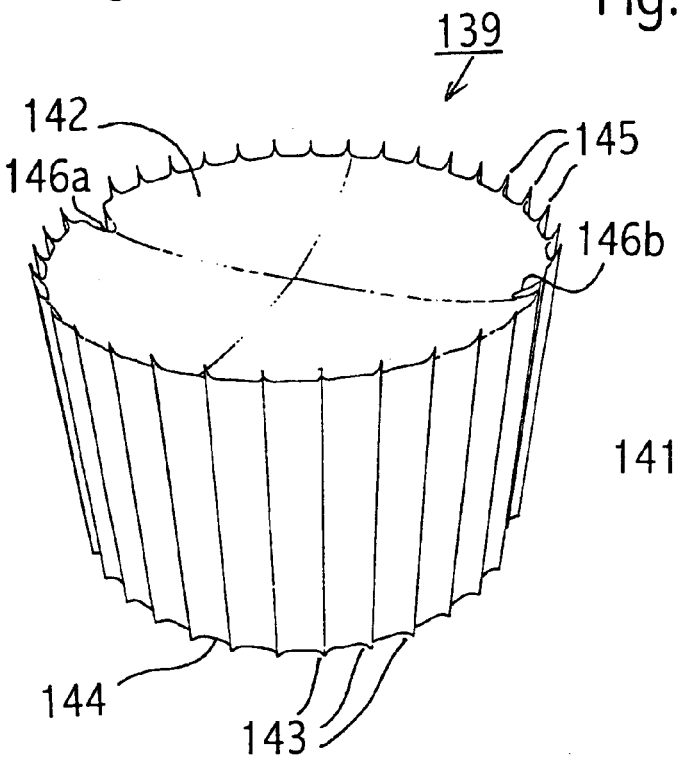
Fig.19-B
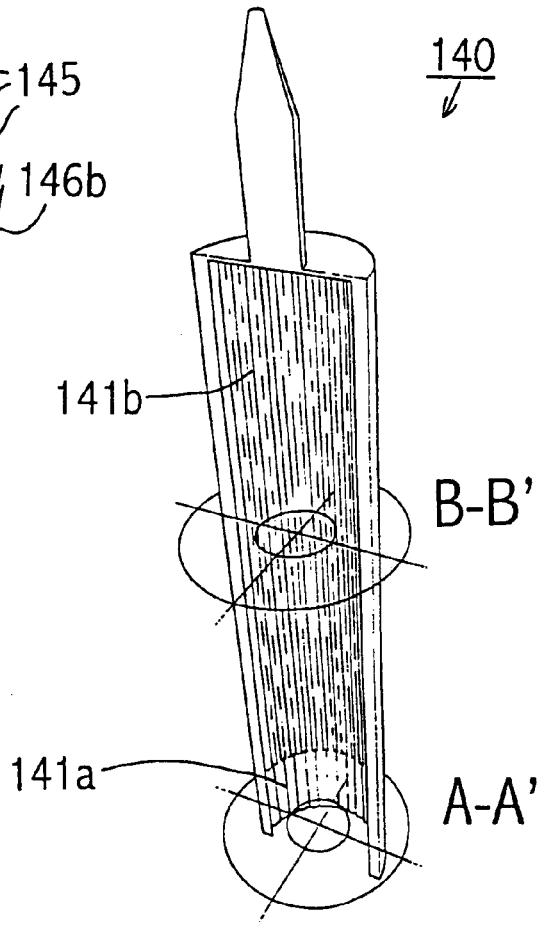

Fig.19-C1
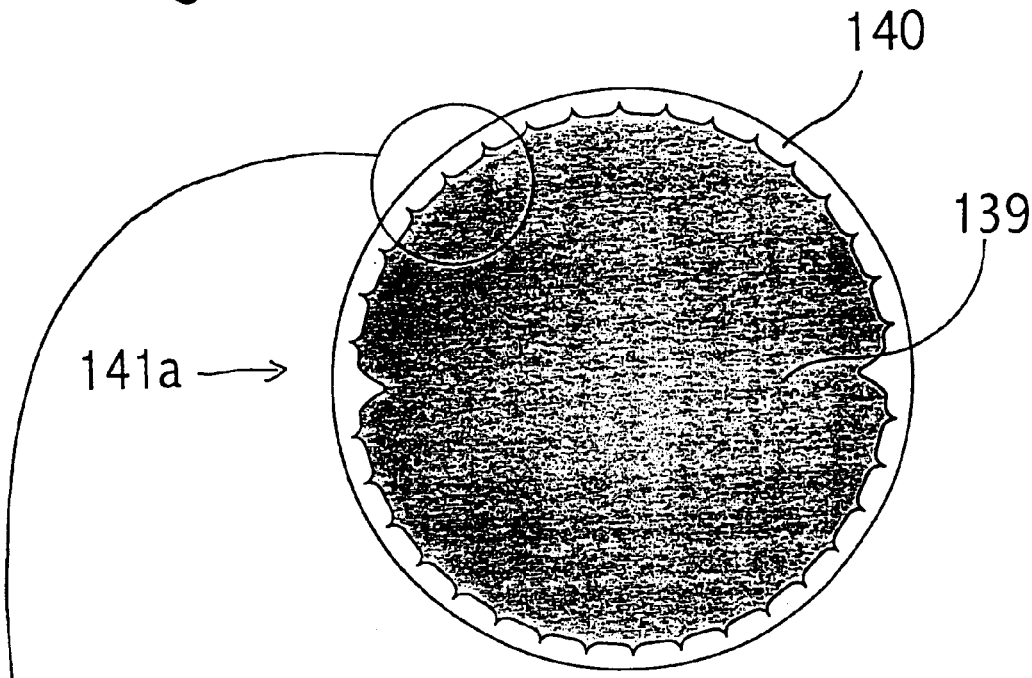
Fig.19-C2
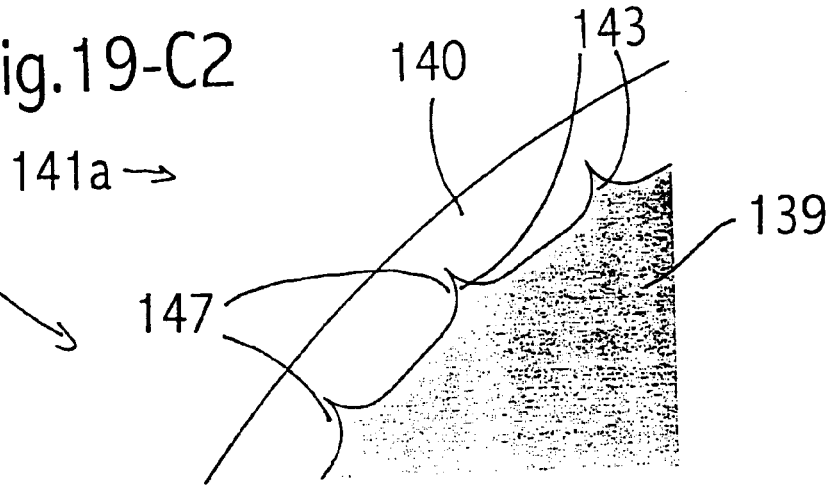

Fig.19-D1
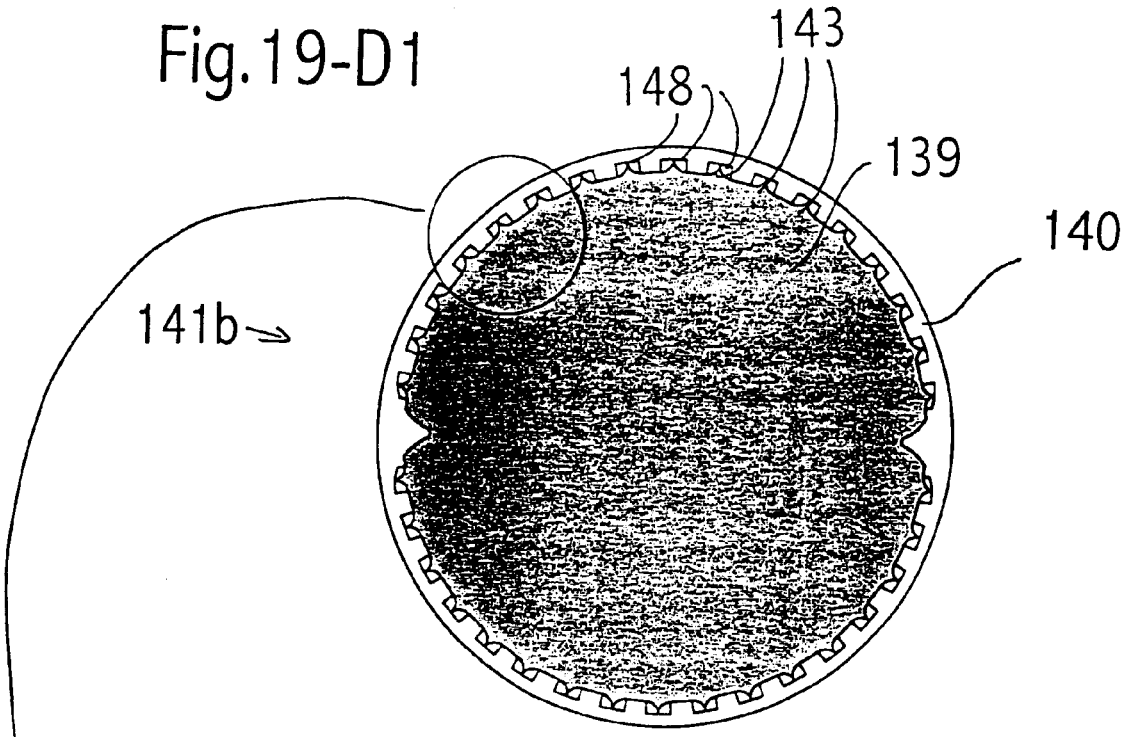
Fig.19-D2
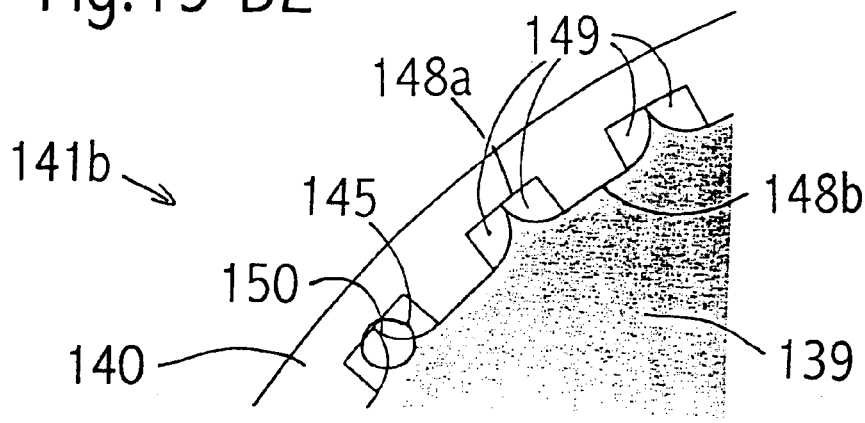

Fig.20-A
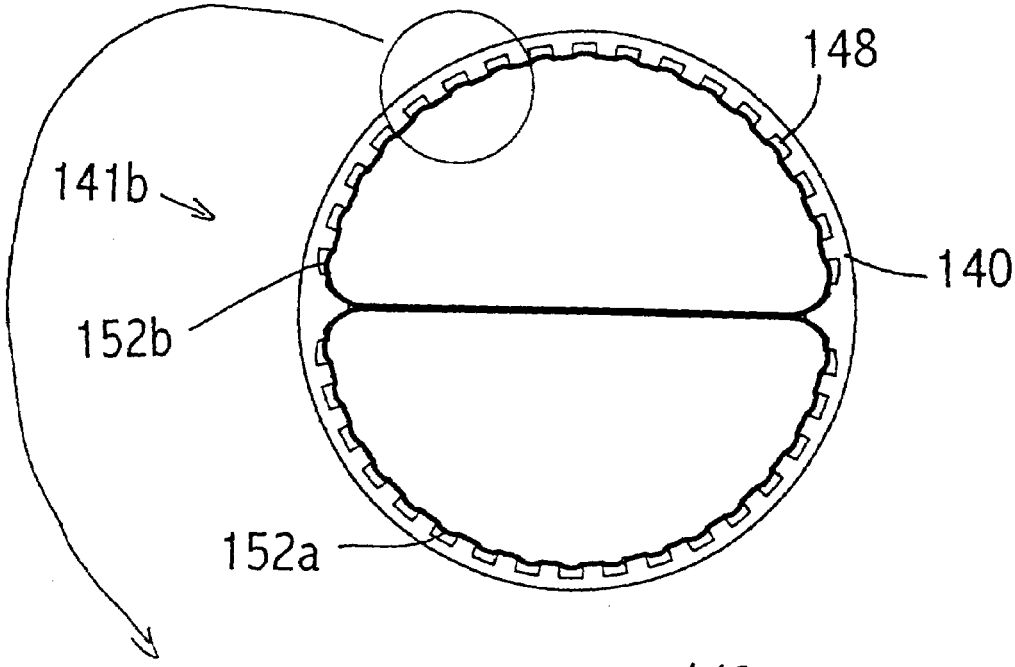
Fig.20-B
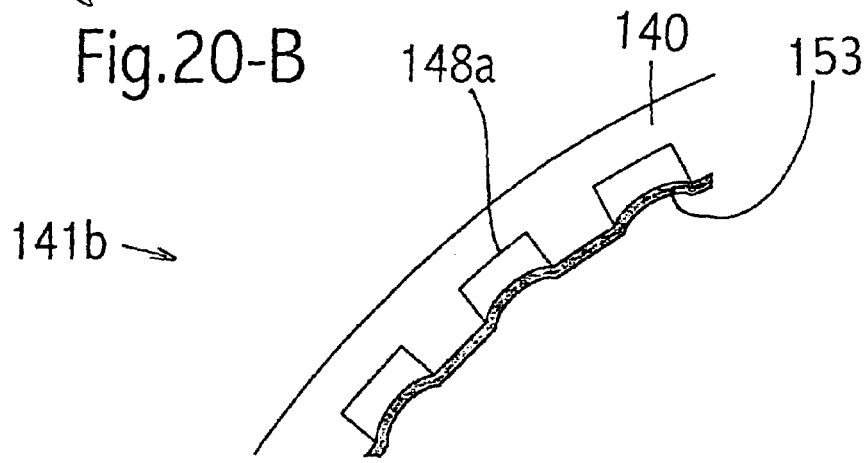

Fig.22-A
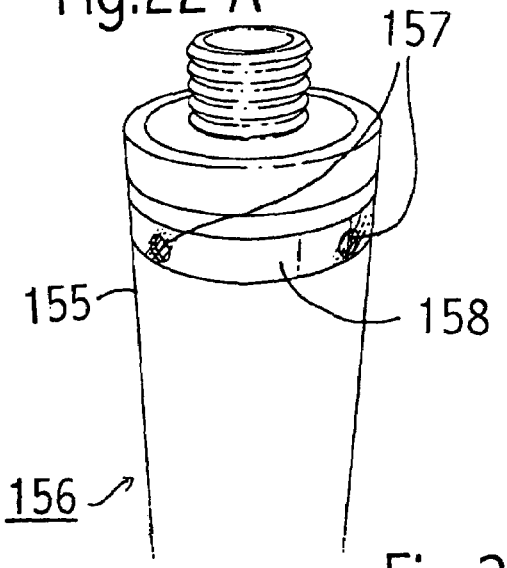
Fig.22-B
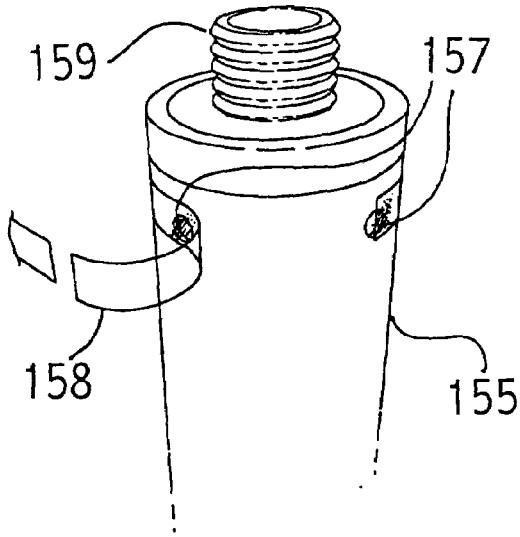
Fig.22-C
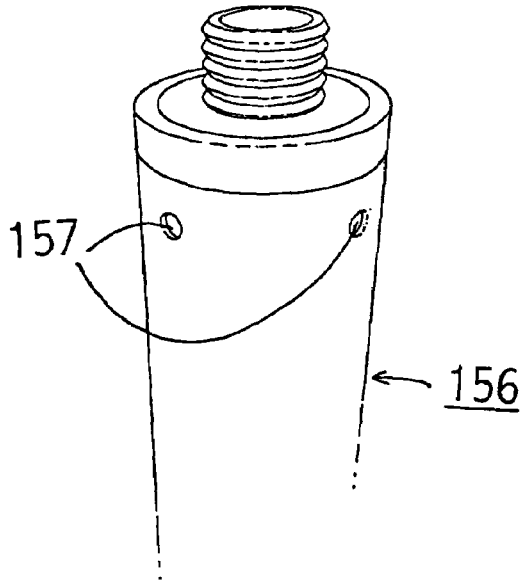

METHOD OF FILLING DISPENSING CARTRIDGES HAVING COLLAPSIBLE PACKAGES

This patent application is a continuation-in-part of U.S. patent application Ser. No. 10/183,107, filed Jun. 26, 2002, titled METHOD OF FILLING DISPENSING CARTRIDGES, now abandoned which is a divisional of U.S. patent application Ser. No. 09/908,420, filed Jul. 18, 2001 titled DISPENSING CARTRIDGES HAVING COLLAPSIBLE PACKAGES FOR USE IN CAULKING GUNS, now U.S. Pat. No. 6,464,112, which is a continuation-in-part of U.S. patent application Ser. No. 09/391,798, filed Sep. 9, 1999, titled PACKAGING FOR MULTI-COMPONENT MATERIALS AND METHODS OF MAKING THE SAME, now abandoned.

FIELD OF THE INVENTION

The present invention is related to self contained cartridges containing chemicals for use in conventional caulking guns, and more particular, the present invention relates to small, single-use, hand-held packaging for the containment and delivery of viscous, pasty reactive chemicals (primarily of the 2-component type, but also comprising 1-component reactive types) that are frequently used as adhesives, sealants, potting compounds, anchoring pastes, etc.

BACKGROUND OF THE INVENTION

Both 1-component and multi-component (but preponderantly, 2-component) chemistries, which include adhesives, sealants, potting compounds, anchoring pastes, and the like (represented by such chemistries as epoxies, polyurethanes, polysulfides, acrylics, silicones, polyesters, etc.), are used throughout the world for bonding, sealing, encapsulating, anchoring and coating many different items in construction, manufacturing, aerospace, medical, transportation, consumer and other market areas. With 2-component chemistries, the two reactive materials are maintained separate from one another and unmixed until just prior to use. To use 2-component chemistries, the components are often mixed in a separate container and applied either using an automatic dispenser or manually. Alternatively, one frequently uses a specialized or custom dispenser having parallel cartridges to dispense the 2-component chemistries with the mixing being accomplished by a static mixer inside the dispensing nozzle.

Despite the inconvenience of having to mix 2-component chemistries or purchase specialty components prior to use, the industry considers 2-component chemistries superior in performance and prefers using 2-component chemistries in most applications. Generally, the industry prefers 2-component chemistries because they frequently have better physical and chemical properties than 1-component chemistries. However, while 2-component chemistries are currently and widely used in certain industries (both from bulk containers and from pre-loaded specialized packaging), such use has been restricted to using relatively expensive and relatively specialized application or dispensing equipment. Therefore, there is a need to provide a reactive-chemical dispensing cartridge packaging, which could be used for both 1-component or multi-component chemistries, that is capable of use in common, standard, inexpensive caulking guns of the type generally found in hardware stores, home centers, paint stores and the like.

It has been recognized previously by such inventors as, for example, Creighton (U.S. Pat. No. 3,323,682), Maziarz (U.S. Pat. No. 5,535,922) and Konuma (U.S. Pat. No. 5,593,066) that it would be advantageous to have a package that permitted the dispensing of 2-component chemistries from common, standard caulking guns, so that all users in all markets could take advantage of the high performance provided by such 2-component chemistries, while enjoying the low cost and ready availability of such standard dispensing equipment. Yet, none of the prior invention disclosures disclose a package design that is: uncomplicated to use by the applicator, technically feasible to manufacture (especially regarding the factory-filling of such containers with high viscosity, pasty materials), sufficiently rugged in its resistance to damage before use, economically viable overall, suitable for dispensing even high viscosity sealants or adhesives, easily recyclable, or comprehensively practical enough to be introduced into or gain acceptance by commercial markets.

Creighton, for instance, discloses no practical design, feasible method of manufacturing, or reasonable method of factory-filling his package with adhesives or sealants (and, consequently, this design has never been commercialized). The Maziarz design, while having found some commercial success, requires the use of a separate rigid adapter to permit the primary all-rigid package to be used in a standard caulking gun, and the maximum volume of material that can be placed into this primary package is only about ¼ to ½ the volume normally possible from packages typically used in such dispensing equipment (and the package cannot be readily recycled). The Konuma design also requires the use of a separate rigid adapter in order to be usable in a standard, common caulking gun. Also, the Konuma design involves a primary collapsible-film package that is much more prone to damage during transport, storage, adapter-insertion or use than typical rigid cartridges that are widely used in standard, common caulking guns.

One commercial package and product currently being sold in Europe (by Artur Fischer (UK) Ltd.—named "FIP 300 SF") has a 2-part "sausage" or "chub", sealed at each end with a strong metal clip, inserted into a rigid plastic caulking cartridge that can be installed in a common, standard caulking gun. Before use, the user pulls one end of the collapsible sausage, with a metal clip attached to it, through the treaded cartridge outlet port and cuts the metal clip is cut off with a knife—thus opening the sausage for dispensing. Then, the user screws a nozzle on the threaded outlet a, with the nozzle typically having a static mixer inside, and mixes/dispenses the 2-component, low viscosity, polyester anchoring mortar.

Several problems exist with this design. First, because the plastic film of the sausage is pulled into and left inside the narrow outlet of the cartridge, the wad of plastic film bunched up inside the outlet port can greatly restrict the flow of the chemical components during dispensing—which may only be a moderate problem if the viscosity of the fluids is very low (as in the case of this commercial "FIP 300 SF" product), but can be a great problem if the product viscosity is high and the product is pasty. Second, it is possible for the chemical components to contact and foul portions of the interior of the rigid cartridge either during dispensing or during spent-sausage removal from the rigid cartridge—making cartridge reuse or recycling very problematic or impossible, and messy in either case. Third, the rigid cartridge has several avenues of gaseous fluid communication between the outside atmosphere and the interior of the package that could partly endanger the shelf life of certain reactive sealants or adhesives during prolonged storage.

It is important to note that many previous inventors have described and, in some cases, commercialized 2-component specialized packaging that is suitable for use only in specialized, relatively expensive dispensing equipment, but not suitable for use in common, standard and inexpensive caulking guns. The commercial market place and the patent literature are replete with many instances of such inventions. Examples of such designs can be found in the works of Blette (U.S. Pat. No. 5,386,928), Sauer (U.S. Pat. No. 5,897,028), Koga (U.S. Pat. No. 6,019,251), Camm (U.S. Pat. No. 5,918,770), Vidal (U.S. Pat. No. 6,047,861), Anderson (U.S. Pat. No. 4,366,919), Penn (U.S. Pat. No. 4,846,373), Schiltz (U.S. Pat. No. 5,566,860), Giannuzzi (U.S. Pat. No. 5,184,757), etc. The present invention, however, permits the use of such reactive materials in simple, affordable and readily available caulking guns, so that virtually everyone, in all industries, can enjoy the benefits of said reactive materials at a low overall cost.

Notably, previous attempts at creating a practical 2-component package for this use have not addressed the need to be able to factory-fill, in a practical manner, such packaging with high viscosity, pasty adhesives and sealants. Either this issue has not been dealt with at all in previously disclosed designs, or, when addressed, the methods outlined or implied have not been feasible. For instance, Keller (U.S. Pat. No. 5,647,510) describes a device that has some similarities to the present invention, but Keller's design calls for the collapsible-film pouches within the device to be attached to one or more relatively small diameter dispensing nozzles that cannot be practically used for filling the pouches causing the pouches to be filled from the rear of said pouches (i.e., at the piston end)—as virtually all previous designers appear to have done, with such a filling approach not being readily or easily accomplished in a practical way. (Notice, in the context of this application, collapsible-film pouches and collapsible packages are generally used interchangeably). In particular, filling pouches from the rear and non-attached end can cause pinching, a crimping of the pouches, which inhibits the dispensing of the chemicals contained in the pouches. Furthermore, by filling the pouches from the rear, it is difficult, if not impossible, to completely fill the pouches with chemicals to fully use the possible volume.

Keller is a useful example of problems associated with conventional methods for filling chemicals in collapsible-film package (and possible explains why none have been successfully commercialized). For example, by filling the package from the rear (which is conventional and exemplified by Keller), the pouch must be held or gripped at the package edge. The gripping to effectuate a filling procedure can damage or weaken the film at the edge and make the edge prone to failure. Further, when filling the packages external to a cartridge body (again conventional and exemplified by Keller and the other cited prior art), they are susceptible to bulging along the length.

When the package bulges, it becomes difficult to insert the bulging package in the cartridge body without damaging the package. Even assuming the package was filled without damaging the edges, and inserted in the cartridge body without damaging the package, sealing the open end of the package (i.e., the end that was filled) is problematic at best. In particular, gathering the open end of the package to seal the package with a traditional clip would likely cause voids or unused space, which is not efficient. Alternatively, using a seal, such as a heat seal, runs the risk of fouling the sealing surface with the chemicals and causing a weaker seal. Finally, and specific to the Keller disclosure, the plunger is not removable from the rear end of the cartridge body (see sealing ring and lips in Keller FIGS. 1, 2, 5, 6, and 7). Thus, the packages in Keller must be filled external to the cartridge body and then inserted in the body, which exemplifies the methods of conventional devices.

If the issue of efficiently filling such packages at the factory is not adequately addressed (and the factory-filling of such high viscosity, pasty materials as adhesives and sealants into hand-held, collapsible-film packaging is far more difficult than the factory-filling of low-viscosity, thin fluids), then it becomes difficult or impossible to economically produce such a package/product combination.

Moreover, the Keller device is not designed as a totally self-contained, integrated package, to be used in a common caulking gun; and, rather than recycling the main rigid cartridge body as taught below in the present invention, Keller's disclosed design calls for his rigid housing to be very stoutly built and aims at the repeated re-use of the stout, rigid housing by inserting fresh, collapsible-film pouches—which are relatively much more fragile and subject to damage, compared to integrated, mostly-rigid containers—into them in the field after the previously-used pouches have been emptied.

It is well known in the trade that 1-component, all-rigid, all-plastic polyethylene caulking cartridges typically used to contain many or most sealant and adhesive chemistries (and dispensed using common, standard caulking guns) are not currently used to contain 1-component, reactive, moisture-curable polyurethane sealants or adhesives. The reason is that such all-plastic containers do not provide sufficient moisture vapor permeability resistance to prevent premature and rapid curing of highly moisture sensitive polyurethanes during storage. Yet, because of the unsurpassed weather and damage resistance (as well as low cost) afforded by such rigid all-plastic containers (compared to the paperboard/aluminum foil cartridges most commonly used for such polyurethanes today), it would be advantageous to use such rigid, plastic containers for such products.

SUMMARY OF THE INVENTION

To attain the advantages of and in accordance with the purpose of the present invention, as embodied and broadly described herein, a method for filing cartridges for use with a conventional caulking gun include securing a collapsible package to the cartridge and applying pressure to an internal space of the collapsible package to expand the package. Drawing a vacuum on the cartridge to reduce pressure in the cartridge and removing the pressure applied to the internal space. The reduced pressure maintains the package in an expanded state. The package is filled and the vacuum released to increase the pressure in the cartridge.

BRIEF DESCRIPTION OF THE DRAWINGS

The accompanying drawings, which are incorporated in and constitute a part of this specification, illustrate some preferred embodiments of the invention and, together with the description, explain the goals, advantages and principles of the invention. In the drawings.

FIGS. 7-A to 7-D show a conventional method of filling cartridge 1 and 4 (prior art);

FIGS. 8-A to 8-M show a show a method of filling a cartridge in accordance with the present invention;

FIGS. 9-A to 9-B show an embodiment of a cartridge in accordance with the present invention;

FIGS. 10-A to 10-B show another embodiment of a cartridge in accordance with the present invention;

FIGS. 11-A to 11-C show still another embodiment of a cartridge in accordance with the present invention;

FIGS. 12-A to 12-B show still another embodiment of a cartridge in accordance with the present invention;

FIGS. 13-A to 13-B show still another embodiment of a cartridge in accordance with the present invention;

FIGS. 16-A to 16-C show a method of using plunger 119 in accordance with the present invention;

FIGS. 18-A to 18-C show a method of using plunger 129 in accordance with the present invention;

FIG. 19-A shows still another embodiment of a plunger in accordance with the present invention;

FIG. 19-B shows a cross-sectional, perspective view of a cartridge usable with plunger 139 in accordance with the present invention;

FIGS. 19-C1 to 19-C2 show plunger 139 and cartridge 140;

FIGS. 19-D1 to 19-D2 show the 139 and cartridge 140;

FIGS. 20-A and 20-B show pouches 152 and 153, and inner tube wall grooves 148 in more detail;

FIGS. 22-A to 22-C shows a method of venting in accordance with the present invention.

DETAILED DESCRIPTION

Figure 1:
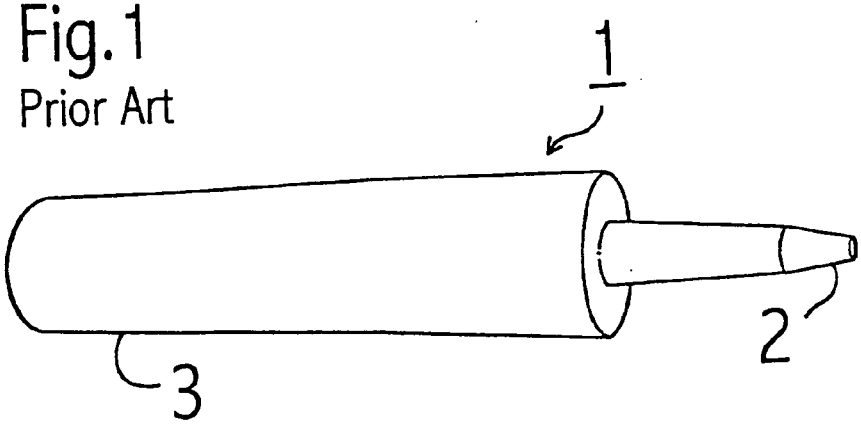
Fig.1 Prior Art
FIG. 1 shows one embodiment of a conventional caulking cartridge (prior art)

FIG. 1 shows a conventional caulking cartridge 1. Caulking cartridge 1 includes a rigid cartridge body 3, an integral nozzle 2, and a plunger (not specifically shown). The plunger is slidably coupled to the rigid cartridge body 3 on the end opposite the integral nozzle 2. Caulking cartridge 1 is a standard, common all-rigid caulking cartridge that is widely used throughout the world for containing and dispensing 1-component chemistries. Chemicals contained within cartridge 1 would be in direct contact with the inside walls of cartridge body 3.

Figure 2:
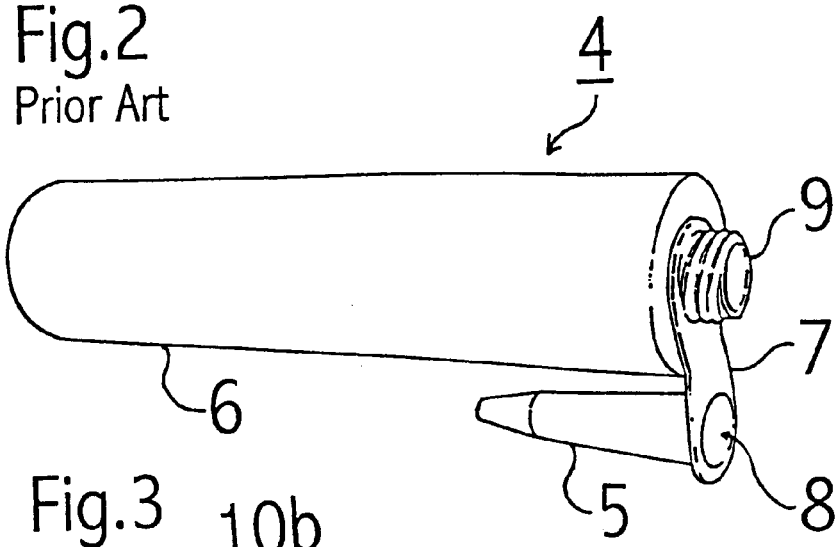
Fig.2 Prior Art
FIG. 2 shows another embodiment of a conventional caulking cartridge (prior art)

FIG. 2 shows another conventional caulking cartridge 4. Caulking cartridge 4 includes a rigid cartridge body 6 and a non-integral nozzle 5. Rigid cartridge body 6 has a threaded nub 9 at one end and a plunger (not shown) at the other end. Non-integral nozzle 5 has matching threads 8. Typically, non-integral nozzle 5 is attached to caulking cartridge 4 by an attachment piece 7. Caulking cartridge 4 also is widely used throughout the world for containing and dispensing 1-component chemistries. Again, chemicals contained within cartridge 4 would be in direct contact with the inside walls of cartridge body 6.

While cartridges 1 and 4 are generally shown to have a cylindrical shape, other geometries are equally possible. Typically, however, conventional caulking guns, explained below, are designed to receive substantially cylindrical cartridges.

Figure 3:
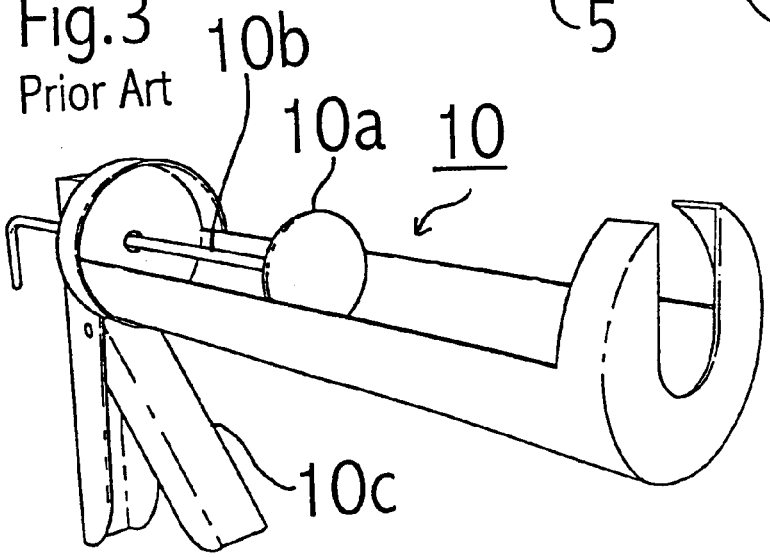
Fig.3 Prior Art
FIG. 3 shows an embodiment of a conventional caulking gun designed for use with cartridge 1 and 4 (prior art)

FIG. 3 shows a typical conventional caulking gun 10. Conventional caulking gun 10 has a push-plate 10*a*, a push-rod 10*b*, and a trigger 10*c*. Conventional caulking gun 10 currently is considered the most widely available and most reasonably priced caulking dispenser known. Users have used caulking gun 10 for over half a century, and it is currently considered the preferred means of dispensing 1-component chemistries.

Conventional caulking cartridge 1 is used with conventional caulking gun 10 by inserting cartridge 1 into an associated cavity (not specifically labeled) in caulking gun 10 such that nozzle 2 protrudes out of a slot (also not specifically labeled) in caulking gun 10 opposite the push-plate 10*a*. To use caulking gun 10 and cartridge 1 after the cartridge is inserted into caulking gun 10, a user "pulls" trigger 10*c*. Pulling trigger 10*c* causes push-rod 10*b* to apply pressure to push-plate 10*a*. Push-plate 10*a*, in-turn, applies pressure to the plunger (not shown) in rigid cartridge body 3 causing the plunger to move towards the nozzle 2. The movement of the plunger towards the nozzle causes the 1-component chemicals to be dispensed out of nozzle 2.

Using conventional caulking cartridge 4 is similar to using caulking cartridge 1 except that a user typically must perform two additional steps. First, nub 9 typically has a cap, cover or plug that prevents inadvertent discharge of the chemicals and to protect the chemicals from the environment. Thus, the user must remove the cap, cover or plug. After removing the cap, cover or plug, the user then connects nozzle 5 to nub 9 by screwing nozzle 5 on nub 9. Once nozzle 5 is attached to nub 9, the operation of conventional cartridge 4 is identical to conventional cartridge 1.

One disadvantage of conventional caulking cartridges 1 and 4 is that the chemicals contained in the cartridge are in direct contact with the inside surfaces of the caulking bodies 3 and 6 as well as the nozzles 2 and 5. By being in direct contact with the bodies and nozzles, the chemicals foul the bodies and nozzles making their reuse or recyclability difficult, if not impossible.

Another disadvantage of conventional cartridges 1 and 4 is that, typically, the bodies 3 and 6 do not provide sufficient isolation from the environment. Thus, conventional cartridges are normally used only for non-reactive chemistries, if the cartridges are made of only plastic.

Figure 4:
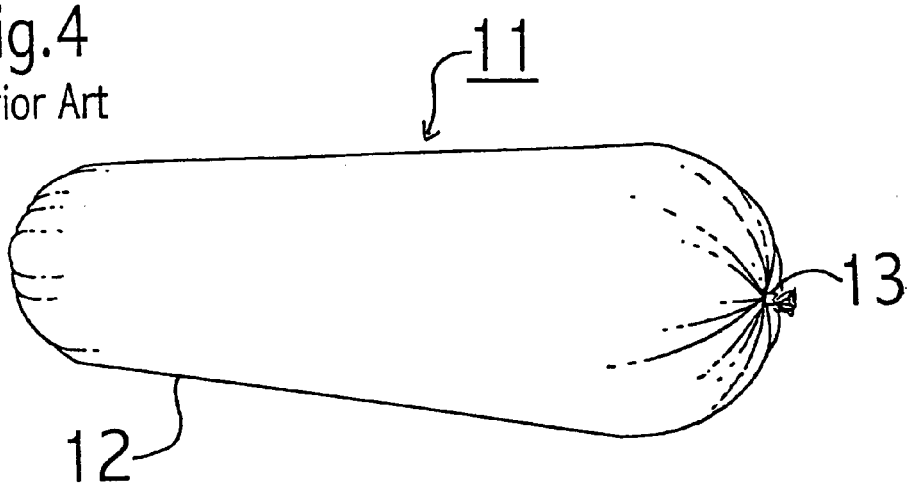
Fig.4 Prior Art
FIG. 4 shows an embodiment of a conventional collapsible-film package used to contain reactive sealants or adhesives (prior art)

FIG. 4 shows a prior art collapsible package 11 for 1-component chemistries. Collapsible package 11 is generally known in the art as a "sausage" or "chub." Collapsible package 11 has a collapsible wall 12 that is, typically, sealed at each end with a mechanical sealing device 13. Mechanical sealing device 13 is typically a metal or plastic clip. While collapsible package 11 is shown to be generally cylindrical, other geometries are possible. While collapsible package 11 can be used to contain non-reactive chemistries, the collapsible package 11 is typically moisture impervious, thus allowing collapsible package 11 to contain reactive chemistries also (typically reactive chemicals are ones that react when exposed to humidity in the air). Moreover, mechanical sealing device 13 could be replaced by other sealing means, such as, heat seals.

Figure 5:
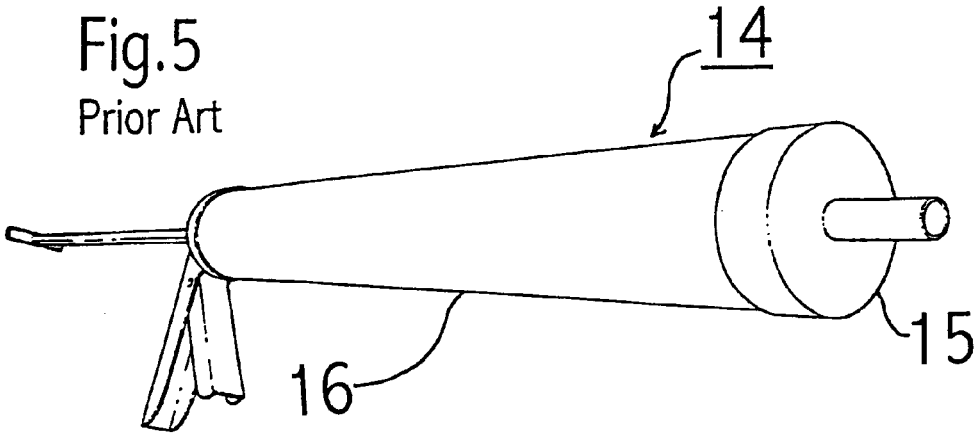
Fig.5 Prior Art
FIG. 5 shows an embodiment of a conventional industrial bulk-caulking gun designed for use with the collapsible-film package 11 (prior art)
Figure 6:
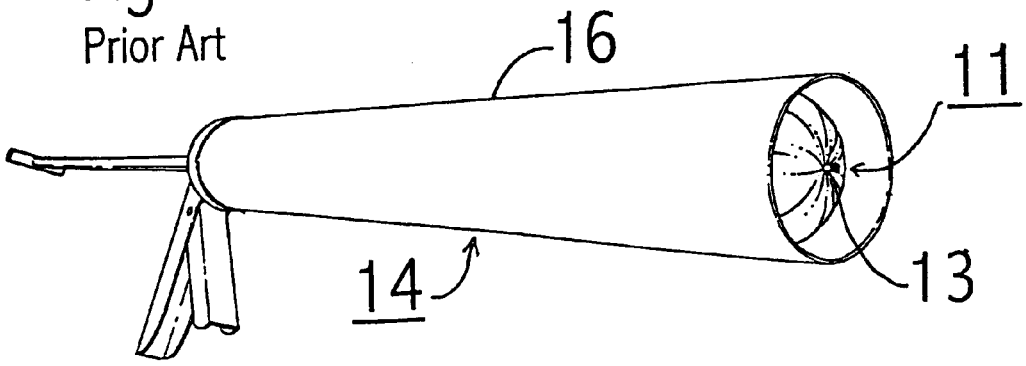
Fig.6 Prior Art
FIG. 6 shows industrial bulk-caulking gun 14 having collapsible-film package 11 insert without the manifold 15 (prior art)

FIGS. 5 and 6 show a specialized, or industrial, caulking gun 14. Industrial caulking gun 14 has an end manifold 15 and a rigid barrel 16. Industrial caulking gun 14 also has a push-plate/plunger, push-rod and trigger (none of which are specifically labeled in the drawing). The push-plate/plunger, push-rod and trigger are arranged and function in a manner similar to conventional caulking gun 10, described above. End manifold 15 is removable (i.e., either threaded or bayonet fitting) so that collapsible package 11 may be inserted into the barrel 16 of the industrial caulking gun 14. Notice that unlike conventional caulking gun 10, which has an open cavity to receive rigid cartridges 1 or 4, the barrel 16 of industrial caulking gun 14 completely surrounds the collapsible package 11. Because rigid barrel 16 completely surrounds collapsible package 11, collapsible package 11 does not need to provide its own rigidity.

Collapsible package 11 has been known in the trade for many years, and offers the benefits of providing good shelf stability for the contained chemicals, low package cost, and minimal packaging waste (both in weight and volume). However, such packages cannot be used in standard, common caulking guns without special adapters because the collapsible-film of the packages would burst without being well supported by a surrounding cylindrical rigid structure, such as, for example, barrel 16.

In operation, a user would remove end manifold 15 from industrial caulking gun 14 and insert collapsible package 11. The user would then remove clip 13 nearest the outlet of the gun, or otherwise puncture collapsible package 11, and insert package 11 in barrel 16. Normally clip 13 is removed with a knife. End manifold 15 would then be placed back in industrial caulking gun 14. With the manifold in place, and the clip 13 removed, pulling the trigger will cause the chemicals contained in collapsible package 11 to be extruded from the barrel 16 through the nozzle associated with end manifold 15. The actual operation of industrial gun 14 is similar to the operation of conventional caulking gun 10.

In normal operation, the collapsible film of the sausage folds up like an accordion as it is progressively squeezed by the action of the push-plate and push-rod (not shown) of the industrial caulking gun 14. Once the contents of the collapsible package 11 are dispensed, the substantially or completely empty collapsed package 11 and remaining clip 13 are removed and disposed. Industrial caulking gun 14 would then be ready to dispense another collapsible package 11. Notice, end manifold 15 and barrel 16 may become partially fouled during use and may require cleaning prior to the next use of industrial caulking gun 14.

Generally, collapsible packages for use in the industrial caulking guns 16 contain only 1-component chemistries. Although at least one inventor, Blette, for example, has described a 2-component package designed for use in such single-barreled industrial caulking guns 16, even though no such 2-component package as designed by Blette appears to have ever been commercialized.

FIGS. 7-A to 7-D show the conventional, normal and universally used method of filling standard, rigid caulking cartridges 1 (FIG. 1) using a filling nozzle 17. While FIGS. 7-A to 7-D show filling a rigid cartridge 1, the method of filling rigid cartridge 4 would be identical. Conventionally, filling nozzle 17 is designed with as wide a diameter opening as is possible to facilitate the flow of high-viscosity, pasty chemistries using low fluid pressures. As shown in FIG. 7-A, a large-diameter factory filling nozzle 17 is inserted into inlet 21 (obviously, caulking cartridge 1 has the plunger removed) into rigid cartridge body 3 to the opposite end of rigid cartridge body 3 to allow for "bottom-up" filling. The industry uses bottom-up filling because if filling nozzle 17 remained at inlet 21, the high-viscosity, pasty chemicals would not readily flow to the nozzle end of caulking cartridge 1 causing either large pockets of trapped air in the filling or cartridge overflow.

The bottom-up approach to factory-filling has proven itself as the preferred method in the adhesives and sealants industry over many years.

In FIG. 7-A the inlet 21 of the all-rigid cartridge 1 is usually positioned directly underneath the factory filling nozzle 17, which typically has a large inside diameter of 1.25", or more (so that the high viscosity, pasty sealant or adhesive will flow as easily as possible through said nozzle, at high speed, and at low pressure). FIG. 7-B shows, in a partial cut-away view, an outlet 18 of the factory-filling nozzle 17 being near the interior bottom 19 of the cartridge 1. Whether the cartridge 1, the factory-filling nozzle 17, or both are moved in relation to each other is largely irrelevant to the fill operation. Generally, however, the filling nozzle 17 moves relative to a stationary cartridge.

After positioning outlet 18 of the filling nozzle 17 near the interior bottom 19 of the cartridge 1, the user can commence filling the cartridge 1 with chemicals. As mentioned above, outlet 18 is placed near the interior bottom 19 (toward the nozzle end) of cartridge 1 because the high viscosity of such pasty materials does not readily allow said materials to easily or quickly flow to the bottom of such containers on their own, and filling the cartridge is facilitated by placing the chemicals there during the filling. Moreover, when filling begins at this position, the adhesive or sealant has the opportunity to displace whatever vapor (usually air) may be in the container prior to the commencement of the filling process, and largely prevent the vapor from being trapped in the container with the sealant or adhesive during factory filling.

FIG. 7-C shows, in a partial cut-away view, the outlet 18 of the filling nozzle 17 having been partially raised up from the interior bottom 19 of the cartridge 1, having left behind a partial deposit of chemical 20. FIG. 7-D shows the completion of the filling cycle, with the outlet 18 of the filling nozzle 17 having cleared the inlet 21 of the cartridge 1, leaving behind a complete deposit of high viscosity, pasty chemical 20 in the rigid cartridge 1. With the completion of this filling cycle, a plunger (not shown) is typically inserted into the inlet 21 of the cartridge 1, and becomes fully ready for use.

This process is called, in the trade, "bottom-up" filling, and is used for many sizes of hand-held packages, up to as large a container as a 29 fl. oz. cartridge. Notice, the arrows in the diagram show the relative movement of filling nozzle 17 with respect to the caulking cartridge 1.

Collapsible packages 11 are formed and filled substantially simultaneously. In particular, collapsible packages 11, or sausages and chubs, are formed and filled using highly specialized and expensive equipment. Generally, to make a chub, a filling nozzle (similar to nozzle 17 in FIGS. 7-A to 7-D) is placed in a heat-sealing unit. The heat-sealing unit uses a "bishop's collar" to form the chub by converting a flat sheet of high barrier collapsible film into an open ended cylindrical tube that has a heat-seal formed down a seam on the side of the tube. The chub has one end of the tube closed, typically with a metal clip, and the fill nozzle is inserted into the other end of the chub up to the closed end. The fill procedure is generally the same as described above, but must be carefully controlled because of the needed back-pressure balance of the collapsible package and the tight overall sequential timing required.

As can be determined from the above descriptions, conventional plastic cartridges have an advantage over chubs in that it is easier to fill such conventional cartridges with chemicals and much less expensive equipment can be used. Chubs, however, have an advantage over conventional plastic cartridges in that they provide better isolation between the chemicals within the chub and the environment (due to films being used that include aluminum foil and other high-barrier materials). Therefore, it would be desirous to develop a cartridge that contained the filling advantage of conventional cartridges with the isolation advantage of the chub (with the a collapsible package also ultimately being permanently protected by the surrounding substantially rigid cartridge).

FIGS. 8-A to 8-G show one embodiment of a new and novel overall package design that permits the factory-filling of cartridges comprised of rigid plastic elements and collapsible packages with high-viscosity, pasty chemicals, that combines the filling and durability advantage of conventional cartridges and the isolation advantages of the chub. For example, the collapsible packages are positioned within the surrounding substantially rigid shell of the cartridge and filled using a conventional fill method. Further, the cartridge design of the present invention allows the collapsible package to be filled (using large diameter fill nozzles) in a bottom-up manner analogous to, but opposite from the method proven for many years in the trade. Such a reversal in filling methods is totally new, unique and novel—and requires the package design of the present invention to allow such a filling method to be used.

FIG. 8-A shows, in cross-section, one preferred dispensing cartridge 22 having at least one collapsible package in accordance with the present invention. Dispensing cartridge 22 has a collapsible inner package 22A and a substantially rigid cartridge body 24. As used in this application, substantially rigid means sufficiently rigid to resist outward movement of the collapsible package when the contents of the collapsible package are being dispensed and sufficiently rigid to substantially maintain its shape when a vacuum is drawn, as explained below. Furthermore, while the embodiments of cartridges described herein generally disclose a cylindrical shape, other geometries are equally possible. The collapsible package 22A includes an open end 27 formed by a retaining collar 28, and a closed end opposite the open end (not specifically labeled). The retaining collar 28 has a collar edge 30. The closed end can be sealed using any conventional means, but it is an industry-accepted practice to use a metal clip as shown. The substantially rigid cartridge body 24 includes an inlet 23 having a perimeter edge 29, which corresponds to collar edge 30, and a plunger end 25. The loading of a non-inflated, pre-fabricated, collapsible package 22A (as, for example, in the recyclable 1-component embodiment of the present invention that is described below) into the nozzle-end opening 23 of the main, rigid cartridge body 24, is accomplished by inserting collapsible package 22A into the substantially rigid cartridge body 24. Notice, unlike the Keller device, the collapsible package 22A has a relatively large diameter open end 27 to permit easy, fast, and low pressure factory filling from this end of the cartridge.

Preferably, the retaining collar 28 is internal to the collapsible package 22A. Moreover, it is preferable to heat-seal collapsible package 22A to retaining collar 28 such that collapsible package 22A covers collar edge 30. As shown in FIG. 8-B, and as will be explained in greater detail in conjunction with other embodiments of the present invention, when collapsible package 22A is inserted into the substantially rigid cartridge body 24, the collar edge 30 of retaining collar 28 abuts the corresponding perimeter edge 29 of the substantially rigid cartridge body 24. As shown, collar edge 30 and perimeter edge 29 have a tapered shape to facilitate the forming of a mechanical seal; however, the edges could have other shapes, such as, for example square, round, curved, elliptical, notched, or others.

As will be explained in more detail below, when a nozzle, or some type of manifold, is threaded on the substantially rigid cartridge body 24, the pressure from threading the nozzle will cause edges 30 and 29 to form a tighter mechanical seal. The mechanical seal, in conjunction with the heat seal, inhibits the collapsible package 22A from moving further down the bore of the cartridge body 24 toward the plunger end 25 of the substantially rigid cartridge body 24. Of course, it is possible to use the mechanical seal or the heat seal alone; however, it is preferred to use both seals. Furthermore, while it is preferable to have tapered edges to form a mechanical seal, the mechanical seal could be formed by a "tight" friction fit between the retaining collar 28 and the inside surface of the substantially rigid cartridge body 24. While not preferred, in the event a mechanical seal is not used, retaining collar 28 could be external to the collapsible package 22A and the leading edge of collapsible package 22A could be heat sealed to the inner surface (not labeled) of the retaining collar 28.

FIG. 8-C shows cartridge 22 with a lubricating means 24*a*. Lubricating means 24*a* can be one or more tubules with jets as shown, manual swabbing, a bath, or any equivalent means of leaving a lubricating residue on either the collapsible package 22A, inner surface of substantially rigid cartridge body 24, or both. In particular, FIG. 8-C shows during, or immediately after, the insertion of the collapsible package 22A into the substantially rigid cartridge body 24, the exterior surfaces of collapsible package 22A and interior surface of substantially rigid body 24 that will experience some frictional resistance, from either a plunger (not shown in FIG. 8-C) or the inner side wall of substantially rigid cartridge 24 are treated with a lubricant 24*a*, like graphite, talc, or light mineral oil, etc., to facilitate the sliding of the plunger over said internal surfaces so as to encourage the film of the pouch to collapse like an accordion rather than getting pinched or torn by the plunger or inner side wall during its sliding travel down the bore of the cartridge.

FIGS. 8-D and 8-E show cartridge 22 with collapsible package 22A inserted into substantially rigid cartridge body 24. Further, the plunger end 25, without the plunger, of the substantially rigid cartridge body 24 is coupled to a vacuum fixture 26. The vacuum fixture 26 would be coupled to, for example, a vacuum pump, not shown, such that when the vacuum pump is activated, it pulls a vacuum on the internal space at the plunger-end 25 of the substantially rigid cartridge body 24.

Pulling a vacuum on the plunger-end 25 causes the collapsible package 22A to "reverse inflate," which expands the pouch and pulls it forcefully toward the plunger end 25 of the cartridge (as shown in FIG. 8-F). When said "reverse inflation" occurs, the collapsible package 22A of the cartridge 22 becomes relatively rigid and opens up to its greatest extent, with said "reverse inflation" greatly reducing or eliminating any creases, twists or folds in the collapsible film that might otherwise occur. When the collapsible package 22A is thus "reverse inflated" from the plunger end, it becomes open and capable of receiving from the nozzle end whatever chemical may be placed in it from the nozzle end. The level of vacuum required to effect the necessary "reverse inflation" of the collapsible package 22A will vary from about 2 inches Hg to about 24 inches Hg, depending on the stiffness of the collapsible material (which is, in turn, largely dictated by the chemical-containment requirements of the particular sealants or adhesives to be packaged). It has been found, however, that to completely reverse inflate the packages is difficult. Thus, it is preferable to apply pressure to the interior of the package 22A to inflate the collapsible package. The inflation reduces or eliminates creases, twists, etc. Once inflated, a vacuum can be pulled to hold the collapsible in the inflated position. The applied pressure can than be removed, which leave the collapsible package in the aforementioned reverse inflated position and filing can proceed as described.

FIG. 8-G shows factory filling nozzle 17 positioned over the nozzle end opening 23 of the "reverse inflated" collapsible package 22A, which is, in turn, positioned within the main rigid cartridge body 24. At this point, the bottom-up filling process sequence begins. The directional arrow shows the direction in which the filling nozzle 17 will travel from this initial position in relation to cartridge 22. As noted above, the cartridge itself could, to equal effect, be the item that moves, rather than the nozzle. Alternatively, the nozzle 17 and the cartridge could accomplish the relative movement by both moving.

FIG. 8-H shows the nozzle outlet 18 positioned near the interior bottom 31 of the "reverse inflated" collapsible package 22A, just before depositing any chemicals. By starting the filling operation at this position, the pasty chemical 20 displaces most or all of the vapor (usually air) within collapsible package 22A. Moreover, the high viscosity, pasty chemical 20 can be placed at the very bottom of the pouch assembly inhibiting the formation of vapor voids and overflow. Without such a placement, and because of the high viscosity of such materials, it would be difficult to properly fill collapsible package 22A with pasty chemicals.

FIG. 8-I shows a partially filled cartridge 22. In particular, during the filling operation, nozzle 17 is (in accord with the arrow shown) traveling in the direction toward the cartridge inlet 37 (in FIG. 8-I, which corresponds to inlet 23 of FIG. 8-A). While moving "up" from the interior bottom 31, nozzle 17 leaves behind a partial deposit of chemical 20.

FIGS. 8-J and 8-K show the completion of the filling cycle. After filling, collapsible package 22A of cartridge 22 is completely, or substantially completely, filled with chemical 20. To protect the chemical 20 from the environment, a film seal 32 can be placed over inlet 23 (or 37) of the substantially rigid cartridge body 24. Seal 32 can be a foil-laminated patch that is heat-sealed to patch receiving lip 33 of inlet 23, but seal 32 could be any equivalent device including, without limitation, a plug, a cap, plastic seal, etc. Alternatively, seal 32 could be attached to collar 28 instead of a patch receiving lip 33 of inlet 23. Seal 32 could be placed prior to removing the vacuum on the plunger end 25 of the cartridge 22. This helps to prevent spillage or leakage out of inlet 23 when the vacuum on the back end of the cartridge 22 is removed.

When the collapsible package is filled in this way, it substantially conforms to the interior surfaces of the substantially rigid cartridge body 24. By substantially conforming to the interior surfaces of the substantially rigid cartridge body 24, the collapsible package 22A receives the support required to resist the pressure developed within the cartridge 22 during the dispensing operation to avoid failure or rupture of the collapsible package 22A. In particular, when installed in the conventional caulking gun 10 (FIG. 3) and when the trigger 10*c* is pulled causing push-rod 10*b* and push-plate 10*a* to apply pressure on the plunger of the cartridge 22, the interior surface of substantially rigid cartridge body 24 prevents the collapsible package 22A from expanding and rupturing, and instead causes the chemical 20 to be dispensed.

FIGS. 8-L and 8-M show additional components to cartridge 22. As shown in FIG. 8-L, the vacuum fixture 26 is vented and removed from the plunger end 25 of substantially rigid cartridge body 24. FIG. 8-L also shows a cartridge manifold 34 being positioned (per the arrow shown) over inlet 23 of the substantially rigid cartridge body 24. A manifold retaining collar 35 (in FIG. 8-M) is then placed on the inlet 23 of the substantially rigid cartridge body 24. Manifold retaining collar 35 overlaps a portion of manifold 34 when being attached to inlet 23 to hold manifold 34 in place. Also, manifold retaining collar mates to the substantially rigid cartridge body 24 via a threaded connection, not labeled, but other connections, such as a bayonet fitting, are possible. Instead of placing seal 32 over the inlet 23 of the substantially rigid cartridge body 24, the seal 32 could be placed over the manifold inlet (or outlet depending on the perspective). If seal 32 was placed over the manifold inlet (not labeled) of manifold 34, manifold retaining collar 35 could be permanently fixed, such as by a weld, to substantially rigid cartridge body 24 because you would not need to remove the manifold 34 to remove seal 32. However, permanently fixing manifold retaining collar 35 substantially reduces the ability to reuse a majority of the parts associated with cartridge 22. Also, FIG. 8-M shows a plunger 36 is slidably inserted into the plunger end 25 of the main rigid cartridge body 24.

It is the unique, novel and functional cartridge design that makes this unique and novel factory filling process possible, necessary and useful.

FIG. 9-A shows the main components of another embodiment of the present invention. FIG. 9-A shows perspective/cross sectional view of a dispensing cartridge 38. Unlike the embodiments described above with respect to FIG. 8 which had one collapsible package 22A, cartridge 38 has multiple collapsible packages 42*a* and 42*b*. Note that while cartridge 38 is shown with two collapsible packages 42*a* and 42*b*, more collapsible packages are possible. Also, while the example shows a double "D-shape" for the collapsible packages 42*a* and 42*b* and the other pieces of cartridge 38, the "D-shape" is exemplary and other shapes are equally possible. Along with the collapsible packages 42*a* and 42*b*, dispensing cartridge 38 also has a substantially rigid cartridge body 39, package retaining collars 44*a* and 44*b*, a plunger 40, a manifold 48, and a manifold retaining collar 49. Generally, plunger 40, manifold 48, and manifold retaining collar 49 are added to the cartridge 38 after collapsible packages 42*a* and 42*b* are filled, however, cartridge 38 could be sold as an empty container without chemicals initially contained therein.

In more detail, collapsible packages 42*a* and 42*b* are shown in the "reverse inflated" or full position. In this position, the ends of collapsible packages 42*a* and 42*b* towards the plunger 40 are closed by seals 45*a*. Conventionally, seals 45*a* are metal or plastic clips or clamps. Alternatively, seals 45*a* could be replaced by other sealing means, such as film-to-film heat sealing. The other end of collapsible packages 42*a* and 42*b* are attached to package retaining collars 44*a* and 44*b*. Package retaining collars 44*a* and 44*b* can have barbed teeth 51 along an outer surface, which will be explained further below. Referring specifically to collapsible package 42*a*, a leading edge 43*a* of collapsible package 42*a* is heat-sealed to an outer tapered edge (not labeled) of package retaining collar 44*a*. While this example uses a heat-seal to seal the collapsible package to the retaining collar, other means of sealing are acceptable, such as induction welding, hot air fusing, thermal impulse, ultrasonics, adhesives, etc. Collapsible package 42*b* is formed in an identical manner to that of collapsible package 42*a* and will not be further described. Collapsible packages 42*a* and 42*b* have package openings that are relatively as large as possible to facilitate fill operations by permitting large diameter fill nozzles to be inserted.

Substantially rigid cartridge body 39 has openings defined by a perimeter edge 46 of substantially rigid cartridge body 39, and internal edges 47 of a dividing septum 53. Generally, the openings defined by perimeter edge 46 and internal edges 47 will match the shapes formed by the package retaining collars 44*a* and 44*b*. In this case, the shapes are back-to-back "D" shapes of equal sizes. Other shapes are equally possible depending on the chemistries contained in the collapsible packages. Preferably, the substantially rigid cartridge package has threaded portion 50, which will be explained further below.

Manifold 48 includes a nub 54 with threads 56, a manifold outlet septum 41, a manifold retaining collar 49, and mating lip 52. Nub 54 and manifold outlet septum 41 form passageways 55. Passageways 55 form the same shape as package retaining collars 44*a* and 44*b*, and perimeter edge 46 and internal edges 47; however, the passageways 55 do not need to be the same shape. Not labeled, manifold 48 can have a shoulder around the perimeter on which a corresponding shoulder of manifold retaining collar can rest. Manifold retaining collar 49 has threads that correspond to threads 50 of substantially rigid cartridge body 39.

Once the collapsible packages 42*a* and 42*b* are fabricated, with the fabrication preferably occurring outside of the substantially rigid cartridge body 39, they are inserted into the substantially rigid cartridge body 39 through the opening defined by perimeter edge 46 and internal edges 47, which are at the end of the substantially rigid cartridge body 39 opposite the plunger 40, and typically filled, using a fill operation generally similar to the fill operation described above in FIG. 8. In this example, one collapsible package is placed on each side of the dividing septum 53.

When the collapsible packages 42*a* and 42*b* are inserted into the substantially rigid cartridge body, the D-shaped package retaining collars 44*a* and 44*b* form a mechanical seal by abutting and mating with the correspondingly tapered perimeter edge 46 of the substantially rigid cartridge body 39 and the tapered inner leading edges 47 of the dividing septum 53. Because the leading edges 43*a* and 43*b* of the collapsible packages 42*a* and 42*b* were coupled to the outer tapered edges of the package retaining collars 44*a* and 44*b*, the mating of the various tapered edges sandwiches the collapsible packages 42*a* and 42*b* between the rigid mating parts forming the mechanical seal.

The sandwiching of the film between these two tapered and mated surfaces in this manner gives the collapsible packages more support and sealing strength than that provided from just the heat-seal to the package retaining collars 44*a* and 44*b*. The seals, for example the heat-seal and the mechanical seal, help inhibit the collapsible package from moving down the bore of the substantially rigid cartridge body during fill operations. Moreover, as shown best in FIG. 9-B, once the manifold 48 and the threaded manifold retaining collar 49 are installed, as shown in the illustration, the pressure supplied to the areas of the sandwiched packages by the action of the retaining collar being screwed onto the male threads 50 of the substantially rigid cartridge body 39 provides an additional mechanical clamping action around the entire perimeter edge 46 and internal edges 47, reducing the risk of failure of the packages in this area.

As described above, the pouch-retaining collars 44*a* and 44*b* are, but do not need to be, equipped with barbed teeth 51 that engage mating lip 52 molded into the corresponding regions of the manifold 48, with the teeth 51 and the lip 52 snapping into one another as the manifold 48 is pressed onto the package retaining collars 44*a* and 44*b* to lock the collapsible packages 42*a* and 42*b* to the manifold 48 so that, when the package-user disassembles the cartridge to recycle most of the dispensing cartridge 38, the fouled elements of the package that contain small amounts of chemical residue will be kept together for disposal and to prevent a mess. Notice, manifold 48 is not typically attached until after the filling operation. Other variations of such an interlocking method are also possible, with such interlocking variations also being within the scope of the present invention. In addition, gaskets (not shown) may also be installed to further seal the junction between the manifold and the retaining collars. Furthermore, instead of screwing the manifold retaining collar to the cartridge body, the manifold may be coupled to the substantially rigid cartridge body using a bayonet mount or other suitable means.

As shown in FIG. 9-A, the substantially rigid cartridge body 39 can have a "jog" 39*a* at the bottom of an inside wall 39*b*. The jog 39*a* of the inside walls 39*b* provides a mechanical stop for the slidably advancing plunger 40. Further, the wall of the substantially rigid cartridge body 39 below jog 39*a* has a greater wall thickness to provide an additional mass of plastic material at this point in the substantially rigid cartridge body 39 to support the presence of the male threads 50 and keep the manifold retaining collar 49 from protruding beyond the outer lines of the said main rigid cartridge body (which would otherwise subject it to more exposure to damage). Other types of mechanical stops could also be used.

The dividing septum 53, with inner leading edges 47 on either side, can be a molded integral part of the substantially rigid cartridge body 39, although it could also be manufactured separately and mated to the substantially rigid cartridge body 39. The manifold outlet septum 41 engages and aligns with the dividing septum 53 so that each passageway 55 is in fluid communication with the corresponding chemical in one of the collapsible packages 42*a* and 42*b*. Thus, the chemicals remain separate until they exit the passageway 55 into a nozzle (not shown), which can contain a static mixing unit.

The plunger 40 can be a conventional plunger or an embodiment of a plunger that is described below.

The nub 54 that protrudes from the center of the outer face of the manifold 48 contains male threads 56 that engage a correspondingly female-threaded disposable nozzle (not shown) that has contained within it a static mixer for properly blending the two components from the cartridge just prior to application. Located within the nub 54 are the two passageways 55 that are in fluid communication with the pouch assemblies 42*a* and 42*b*, directing the contents of the cartridge to the nozzle and the static mixer (not shown). Prior to use and during storage, the outlet openings of the nub 54 are closed with a plastic/metal-foil-laminated patch (not shown) that can be heat sealed to the perimeter of said outlet openings (with other closing methods also being possible), with the heat-sealed patch being removable before the cartridge is used. Notice that while it is preferable to have nub 54 be coupled to the nozzle by a threaded connection, other connections are possible, such as for example, a bayonet mount or other suitable means.

The components of this embodiment that are easily recyclable are: the substantially rigid cartridge body 39, the cartridge plunger 40, and the threaded manifold retaining collar 49, which components constitute the majority of the weight of the empty cartridge. The rest of the components of the cartridge 38, including the collapsible packages 42*a* and 42*b* and the manifold 48, will not be recyclable (at least not without some form of cleaning), and can be disposed of after the contents of the cartridge are dispensed.

FIG. 9-B shows the identical components of FIG. 9-A, except that in this illustration the components are assembled.

FIG. 10-A shows another embodiment of the invention, highlighting the nozzle-end of the cartridge 57 (with the plunger-end portion of this version being identical to the embodiment shown in FIG. 9-A and FIG. 9-B). In many respects, the cartridge 57 is similar to the cartridge 38, and such similarities will not be re-explained. In fact, the assembly is identical to cartridge 38 except that the leading edges 59 of the collapsible packages 58*a* and 58*b* are coupled to the perimeter edge 60 and the internal edges (not specifically labeled) of the dividing septum 66 instead of to package retaining collars. By coupling the collapsible packages 58*a* and 58*b* to perimeter edge 60 and the internal edges, the package retaining collars can be eliminated from the design.

Then, once the two respective chemical components are deposited within the collapsible packages 58*a* and 58*b*, the manifold 63 is lowered into place so that the tapered bottom edges 64 of the manifold 63 are abutted and mated to the corresponding interior tapered leading edges 60 of the substantially rigid cartridge body 62. Then, once the threaded manifold retaining collar 65 is screwed onto the threaded end 61 of the substantially rigid cartridge body 62, with the leading edges 59 of the collapsible packages 58*a* and 58*b* clamped between the mechanical seal formed by the mating tapered surfaces, the leading edges become mechanically supported around their entire perimeter, thus reducing the risk of failure of the film at this critical point. Moreover, once the clamping operation has been completed, it is then possible to cause the film to be sealed to both rigid surfaces 60 and 64, by heat sealing ultrasonic sealing, induction heating, thermal impulse or other means, to more positively effect a total seal at this junction. The septum 66 shown can be an integral part of the substantially rigid cartridge body 62 and both parts can be monolithically injection molded together when initially created. Alternatively, the septum 66 and the substantially rigid cartridge body 62 could be made separately. If made separate, septum 66 needs to be attached to the substantially rigid cartridge body 62. The attachment could be via glue, adhesives, heat sealing, snapping in place, latches, etc. The septum 66 is generally identical to the septum 53 shown in FIG. 9-A and FIG. 9-B.

In this embodiment, only the manifold retaining collar is readily recyclable.

FIG. 10-B shows the identical components of FIG. 10-A, except that in this illustration the components are assembled.

FIG. 11-A shows another embodiment of the present invention. In particular, FIG. 11-A shows a perspective cross-sectional view of dispensing cartridge 67. Similarly to dispensing cartridges 38 and 57, cartridge 67 has a plurality of collapsible packages 69 and 70, a substantially rigid cartridge body 68, a plunger 92, a manifold 83, and a manifold retaining collar 84. Unlike dispensing cartridges 38 and 57, however, cartridge 67 has concentric outer collapsible package 69 and inner collapsible package 70 instead of, for example, side-by-side collapsible packages 42*a* and 42*b*. Thus, cartridge 67 also has a concentric septum 82. Concentric septum 82 can be a separate piece or molded to manifold 83. As will be explained further below, substantially rigid main body 68, plunger 92 and manifold retaining collar 84 are recyclable (which components represent the vast majority of the weight of the empty container), with the remainder typically being discarded as waste, but capable of being reused if cleaned. Further, while cartridge 67 is shown with two concentric packages, more concentric packages could be used depending on the chemistries desired.

Outer collapsible package 69 has a leading edge 71 defining a central opening 78, and an outer package retaining collar 73. Further, outer collapsible package has an end opposite central opening 78 that is closed with seal 80. Seal 80 is shown to be a conventional metal or plastic clamp or clip, but seal 80 could be any type of seal, such as a heat seal. Outer package retaining collar 73 has an outer perimeter edge 72, an inner perimeter edge 79, and optionally has collar support ribs 75*b*. Preferably, leading edge 71 is heat sealed to the outer perimeter edge 72 of the outer package retaining collar 73. Outer perimeter edge 72 and inner perimeter edge 79 can have tapered edges. Further, outer package retaining collar 73 can have barbed lips or grooves 88, which use will be explained further below.

Inner collapsible package 70 has a leading edge 74, which also defines an opening (not labeled), and an inner package retaining collar 77. Further, inner collapsible package 70 has an end opposite the opening (not labeled) that is closed with seal 80. Seal 80, conventionally is a metal or plastic clamp or clip, but seal 80 could be any type of seal, such as a heat seal. Inner package retaining collar 77 has an outer perimeter edge 76, preferably tapered. Inner package retaining collar 77 can have barbed lips or grooves 88 also, which use will be explained further below. Preferably, leading edge 74 is heat sealed to the outer perimeter edge 76 of the inner package retaining collar 77. Notice, while inner collapsible package 70 and outer collapsible package 69 are shown closed with a single seal 80, outer collapsible package 69 and inner collapsible package 70 could have a separate seal as a matter of design choice.

Inner collapsible package 70, with the leading edge 74 heat sealed to the outer perimeter edge 76, is inserted into the central opening 78 of the outer collapsible package 69. When inserted, the tapered outer perimeter edge 76 of the inner package retaining collar 77 mates with the corresponding tapered inner perimeter edge 79 of the outer package retaining collar 73. Thus, forming the concentric inner and outer collapsible packages 70 and 69.

The mating of perimeter edge 76 and inner perimeter edge 79 sandwiches the leading edge 74 of the inner collapsible package 70. Leading edge 74 can be sealed to inner perimeter edge 79 via heat sealing, ultrasonic sealing, induction heating, glues, adhesives, or other equivalent methods of sealing generally known in the art. The sandwiching of the leading edge 74 forms a mechanical seal to provide a clamping effect that gives mechanical support to the leading edge 74 of the inner collapsible package 70. If leading edge 74 is heat sealed to either perimeter edge 76 or inner perimeter edge 79, the heat seal provides support for the inner collapsible package 70.

Substantially rigid cartridge body 68 includes leading edge 81 and threads 91. When the inner and outer collapsible packages 70 and 69 are inserted in the substantially rigid cartridge body 68, a tapered portion of leading edge 81 forms a mechanical seal by abutting the corresponding tapered portion of outer perimeter edge 72 or outer package retaining collar 73. The leading edge 71 of outer collapsible package 69 is sandwiched between outer perimeter edge 72 of the outer collapsible package and inner leading edge 81 of the substantially rigid cartridge body 68. The sandwiching provides a clamping effect that provides additional mechanical support to the outer collapsible package 69.

Once the concentric inner and outer collapsible packages 70 and 69 are filled with chemicals, then a patch (not shown) can be sealed to a patch-receiving lip 85 of the inner package retaining collar 77 to provide enhanced isolation for the chemical contained within the inner collapsible package 70. The patch could be a plastic or foil laminate, or adhesives, a cap, a plug, etc. The patch provides separation between the chemical contained in the inner collapsible package 70 and the environment as well as the chemical contained in the outer collapsible package 69. The patch would be ruptured, punctured, or removed by the user prior to attempting to dispense the cartridge contents. If one of the chemistries contained in the concentric inner and outer collapsible packages 70 and 69 is more reactive to the environment then the more sensitive of the chemicals could be placed within the inner collapsible package 70 such that the outer collapsible package 69 (along with the patch sealed to the patch receiving lip 85), and the chemical in the outer collapsible package 69, would provide additional isolation from the environment. While not specifically shown, a separate patch could be provided over the outer package retaining collar 73, also. Alternatively, one patch could be provided over both the outer package retaining collar 73 and the inner package retaining collar 77.

Concentric septum 82 has septum alignment ribs 75*a* and a barbed groove or lip 87. Barbed groove or lip 87 corresponds to the barbed lip or groove 86 of the inner package retaining collar 77. Concentric septum 82 has an opening that defines an inner passageway (not labeled). Concentric septum 82 is connected to the inner package retaining collar 77 by snapping barbed groove 87 into barbed lip 86. Alternative connection means, such as snaps, glues and adhesives, are possible instead of the barbed groove and lip. Moreover, gaskets, such as "O-rings," may be placed at the interlocking interface. While not necessary, aligning alignment ribs 75*a* with outer package retaining collar ribs 75*b* decreases resistance to the flowing of the chemicals during dispensing.

Manifold 83 fits over concentric septum 82. Of course, it is possible to design manifold 83 and concentric septum 82 as a single unit; however, for clarity, they have been shown as separate components. Manifold 83 has a barbed lip or groove 89 and a nub 90. Nub 90 has threads and a nub opening. The nub opening is of a larger diameter than the concentric septum opening and the space between the nub opening and the septum opening defines an outer passageway (not labeled). Barbed lip 89 can couple with the corresponding lip or groove 88 in the outer package retaining collar 73. The coupling between lips 89 and 88 can be eliminated, or accomplished in a number of different ways, such as pegs and holes, glues, tapes, etc.

The manifold retaining collar 84 fits over manifold 83 and couples to the threads 91 on the substantially rigid cartridge body 68. Other means of attachment are possible, such as a friction fitting, glues, heat seals. Also, while not labeled, it is possible to provide matching shoulders on manifold 83 and manifold retaining collar 84.

While sealing the chemicals was explained above, it is possible to replace the seals on, for example patch receiving lip 85 with a seal over the opening defined by the nub 90, or use patches at both locations for enhanced sealing.

During dispensing, the chemical in the inner collapsible package 70 moves to the outlet through the inner passageway defined by the concentric septum 83. The chemical in the outer collapsible package 69 moves to the outlet by moving around ribs 75*a* and 75*b* and through the passageway defined by the space between the nub 90 of manifold 83 and the concentric septum 82. The concentric septum unit 82 provides a barrier between the chemical from the inner collapsible package 70 and the chemical from the outer collapsible package 69 until they emerge at the outlet and enter the dispensing nozzle (not shown) and the static mixer (not shown, but which is normally contained within the dispensing nozzle).

Several joints, abutments, and mating surfaces have been identified above. Each of these "mechanical seals" can include a gasket, such as an "O-ring" or adhesive. Also, the above identified locking mechanisms using barbed lips or grooves, which can be removed or accomplished by alternative means, can be useful for disassembling the cartridge 67 for recycling the major parts of the cartridge after use.

Couplings defined above by threaded connections or friction fittings could also be accomplished by other devices, such as, metal bands or spin-welded plastic rings.

The plunger 92 is slidably inserted into the rear of the main rigid cartridge body 68. Other embodiments of plunger 92 are possible, some of which are explained further below.

The outlet end of the nub 90 can be sealed (via ultrasonics, induction weld sealing or other means) with a peelably removable plastic/aluminum-foil patch (not shown), or the outlet opening of the nub 90 can be sealed in other common alternative ways to isolate the contents of the cartridge from the outside atmosphere until the user opens the package to dispense the contents of the container.

FIG. 11-B, FIG. 11-C show the same components as shown in FIG. 11-A, except in cross-sectional, assembled views to more clearly show the relationship of the described components.

FIG. 12-A shows the nozzle-end of another embodiment of a dispensing cartridge. In particular, FIG. 12-A shows a collapsible package 94 having a leading edge 93, a retaining collar 96 with a perimeter edge 95, a substantially rigid cartridge body 97 having a leading edge 99 and threads 102, a manifold 100 having a nub 103 and a passageway 104, and a manifold retaining collar 101.

Retaining collar 96 is placed internal to leading edge 93 of collapsible package 94. Leading edge 93 is sealed to the perimeter edge 95 using ultrasonic bonding, thermal bonding, thermal impulse bonding, induction-welding, glues, tapes, bands, or other methods, to form a collapsible package assembly 98.

Just like the embodiment described in FIGS. 8-A to 8-M, this embodiment is specifically designed for 1-component chemistries that are reactive to the environment, such as moisture-cured polyurethanes (in particular), polysulfides and some silicones that currently cannot be packaged in conventional all-plastic rigid caulking cartridges successfully because the moisture-vapor transmission rate (MVTR) through the plastic side-walls of such packages is too high to prevent the reactive chemistries from curing in the package after factory-filling and during storage. In particular, the plastic used for such conventional cartridges is polyethylene or polypropylene, because of their low cost and ease of injection molding or extrusion, among other reasons. The present invention provides an external, substantially rigid package, using such plastics as polyethylene or polypropylene, but provides an improved MVTR to conventional packages because of the use of the internal collapsible package that can be composed of, for example, aluminum foil, aluminum foil laminated within a plastic film sandwich, plastics with high resistance to moisture vapor transport. These packages make it possible to contain environmentally reactive chemistries with its major external substantially rigid components made of plastic.

To reiterate, the package assembly 98 is inserted into the substantially rigid cartridge body 97 from the nozzle end such that the tapered outer perimeter 95 of the package retaining collar 96 abuts and mates with the corresponding tapered leading edge 99 of the substantially rigid cartridge body 97, with the leading edge 93 of the collapsible package 94 being clamped between the two said rigid plastic components. This mechanical clamping action further supports and strengthens the ability of the collapsible film at this juncture to resist failure when pressure builds within the cartridge during dispensing or filling.

After the collapsible package 94 is filled with chemical, manifold retaining collar 101 is threaded to manifold 100 using threads 102 assist the clamping in a manner similar to that described in the previous embodiments. Similar to the embodiment described in FIGS. 8. FIG. 12-A shows an embodiment that has no septum within the outlet channel 104 of the nub 103. The septum is generally unnecessary for 1-component chemistries because the chemistry does not need to be mixed via a static mixer on the nozzle (neither shown); however, it is possible to have a septum in the outlet channel as a matter of design choice. For example, if a septum was integral to manifold 100, the manifold 100 could be manufactured in a manner similar to manifold 48 (FIG. 9-A), which may have some manufacturing advantages.

The components that are easily recyclable in this embodiment are the main rigid cartridge body 97, the plunger (not shown), and the threaded manifold retaining collar 101.

FIG. 12-B shows the components of FIG. 12-A assembled.

FIG. 13-A shows the nozzle end of another embodiment of the present invention in an exploded, cross-sectional view. FIG. 13-A shows a 1-component chemistry cartridge similar to the embodiment shown in FIG. 12-A. In particular, the cartridge in FIG. 13-A includes a collapsible package 106 with a leading edge 105, a substantially rigid cartridge body with a leading edge 107, a manifold 110 with a leading edge 109, and a manifold retaining collar. Unlike the embodiment shown in FIG. 12-A, this embodiment does not include a package retaining collar. Thus, instead of bonding, or sealing, leading edge 105 of collapsible package 106 to a retaining collar, leading edge 105 is bonded either directly to leading edge 107 of the substantially rigid cartridge body 108, to leading edge 109 of manifold 110, or both. Of course, leading edge 105 does not necessarily have to be bonded to either leading edge 107 or 109. Once again, the bond could be formed using any known technique such as, ultrasonic bonding, thermal-impulse bonding, induction welding, etc.

If the leading edge 105 of the collapsible package 106 is bonded to the leading edge 107 of substantially rigid cartridge body 108, then the manifold retaining collar 111 is easily recyclable. If the leading edge 105 is not bonded to leading edge 107, then the substantially rigid cartridge body is also easily recyclable.

FIG. 13-B is identical to FIG. 13-A, except that it shows the nozzle-end of this embodiment assembled.

Figure 14:
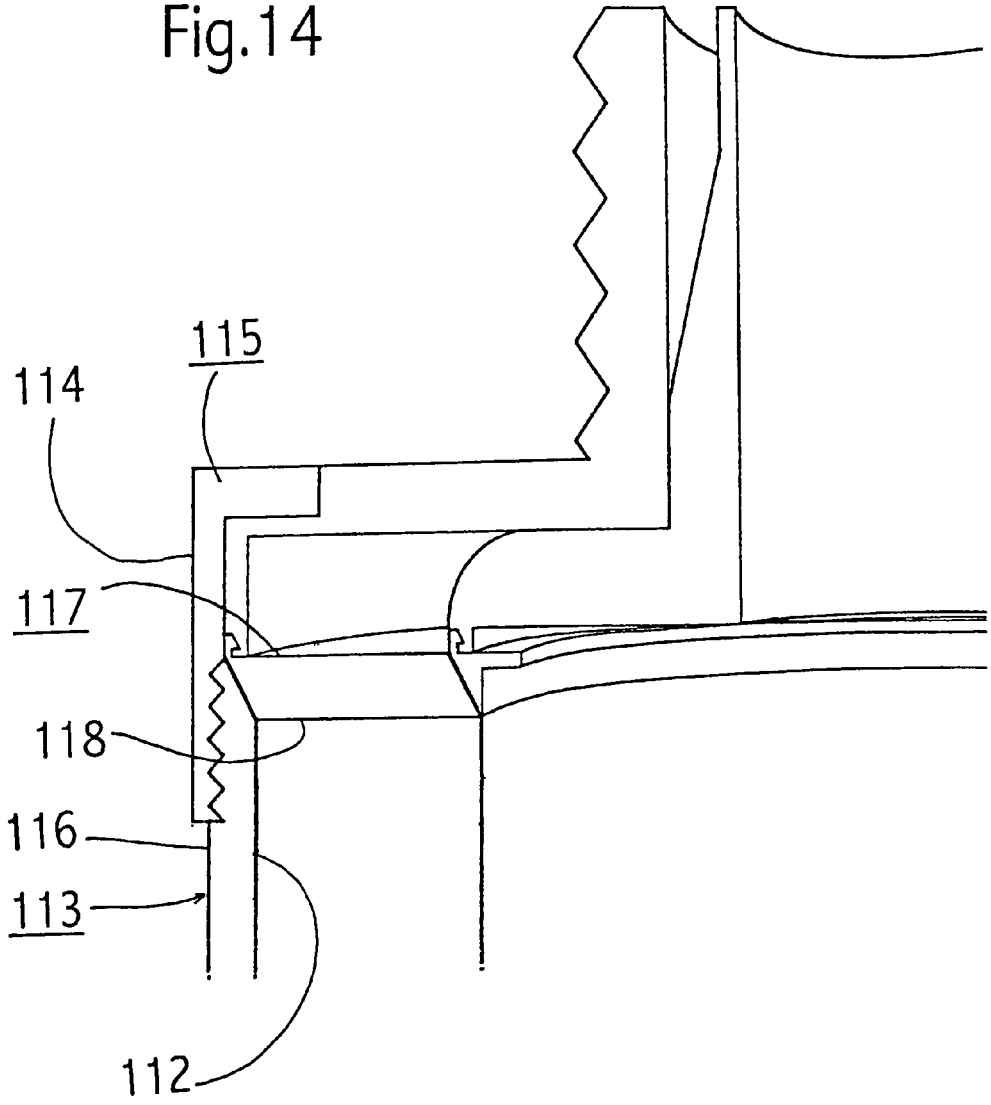
FIG. 14 shows a variant of the inside wall configuration shown in FIG. 11-A.

FIG. 14 shows a quarter cross-sectional view of the nozzle-end of a variation from the substantially rigid cartridge body described above. In this design, an interior sidewall 112 of the substantially rigid cartridge body 113 does not have an interior mechanical stop, such as the mechanical stop 38*a* in FIG. 9-A. Such a smooth continuity of the interior sidewall in the longitudinal direction, up to the bottom 118 of a collapsible package retaining collar 117, of the interior of the said main rigid cartridge body can permit further travel of the plunger (not shown) down the bore of the tube than otherwise, and can permit more of the contents of the pouches to be dispensed as a result. However, in so doing, the outer circumferential surface 114 of the threaded manifold retaining collar 115 would typically protrude beyond the outer circumferential surface 116 of the main rigid cartridge body 113 and make the said threaded manifold retaining collar somewhat more prone to damage during transport and handling. Either design or similar designs are within the scope of the present invention.

FIG. 14 also best shows the mechanical seal that has been referred to throughout the application. Because the mechanical seals are generally similar, only one is described. In particular, FIG. 14 shows a mechanical seal 118A being formed by the leading edge of substantially rigid cartridge body 113 and the leading edge of the collapsible package retaining collar 117. While this mechanical seal is shown by two mating tapered surfaces, the mechanical seal could be formed by flat surfaces, squared off surfaces, rounded surfaces, ribbed surfaces, off-set surfaces. Moreover, it would be possible to design a collapsible package retaining collar 117 to fit completely within substantially rigid cartridge body 113 such that the mechanical seal 118A is minimal or non-existing. Hence, unlike Keller's design, the present invention can provide continuous mechanical seals for all pouches in all configurations.

Figure 15:
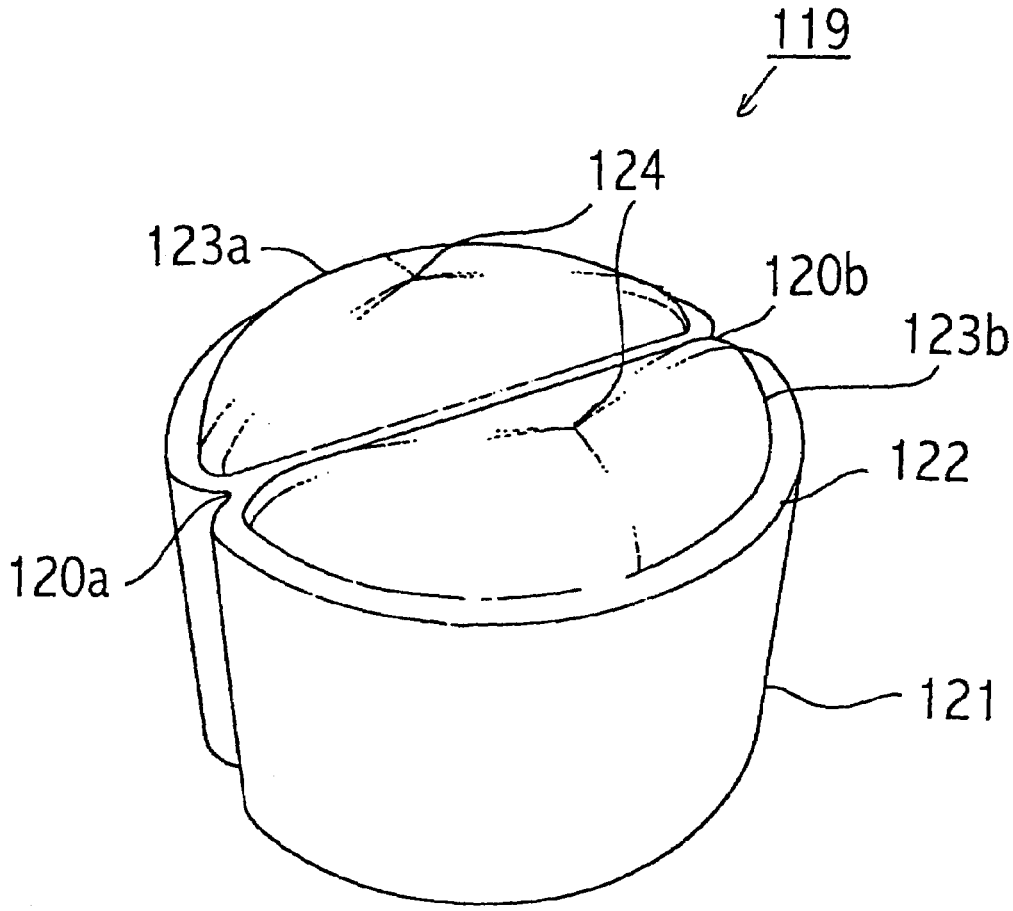
FIG. 15 shows an embodiment of a plunger in accordance with the present invention.

FIG. 15 shows an embodiment of a plunger 119 in accordance with the present invention. The plunger 119 is typically a molded plastic, but could be metallic or some equivalent. Plunger 119 is used to transfer pressure applied to trigger 10*c* (FIG. 3) to the collapsible package(s) such that the chemicals are dispensed from the cartridge. Plunger 119 includes a plunger outer surface 121 with alignment grooves 120*a* and 120*b*, a leading face 122 with lobes 123*a* and 123*b*. While plunger 119 is designed for the equal volumetric side-by-side collapsible packages 42*a* and 42*b* (FIG. 9-A), the plunger 119 could be used with other configurations of collapsible packages, including non-equal volumetric side-by-side collapsible packages. Further, plunger 119 could be used with single collapsible packages and/or concentric collapsible packages; however, after dispensing the chemicals in these packages, the section on leading face 122 between lobes 123*a* and 123*b* would likely still contain un-dispensed chemicals. Thus, a plunger for one component chemistries would likely be designed with one or no lobes.

Alignment grooves 120*a* and 120*b* in outer surface 121 are designed to help maintain plunger 119 in proper alignment with the collapsible packages to facilitate complete dispensing of the chemicals contained in each of, in this embodiment, two collapsible packages. Alignment grooves 120*a* and 120*b* are shown as generally "V-shaped" grooves; however, the grooves could be rounded, such as a "U-shaped", or square or some other shape. Moreover, while two alignment grooves are shown, more or less could be used as a matter of design choice. Further, the grooves do not need to have 180 degrees separation, but could be placed closer together. Further, instead of alignment grooves, plunger 119 could have alignment rails or lips.

The alignment grooves 120*a* and 120*b* engage correspondingly shaped rails 127*a* and 127*b* (shown in FIG. 16-A) located internally within a substantially rigid cartridge body 126 (also, shown in FIG. 16-A). While not shown, alignment grooves 120*a* and 120*b* and corresponding rails 127*a* and 127*b* could have a shoulder or lips to form interlocking channels to assist in maintaining proper alignment.

The leading face 122 of the plunger 119 (as used herein, leading face means the surface of the plunger in contact with the collapsible packages instead of the surface in contact with, for example, the push-plate 10*a*, FIG. 3) is composed of raised lobes 123*a* and 123*b* (with the lobes shown being designed for the side-by-side cartridge embodiments described in FIG. 9-A and FIG. 10-A) whose transverse lobe centers 124 positionally correspond with the transverse centers of the cartridge pouches, whether side-by-side or concentric, and whose purpose is to compress the pouches against the manifold end of the cartridge at the very end of the dispensing cycle to assist in ejecting as much chemical from the cartridges as possible. In order for this function to occur properly, the raised dispensing lobes 123*a* and 123*b* are kept in proper alignment with the transverse centers of the collapsible packages. Further, (by use of such alignment rails) the plunger 119 can be prevented from running into obstacles such as the dividing septum 53 of FIG. 9-A.

In this embodiment, the alignment grooves 120*a* and 120*b* of the plunger 119 assist in proper positioning of the plunger 119 when it is first slidably coupled to a substantially rigid cartridge body. Further, the alignment grooves of the plunger 119 help prevent the plunger 119 from rotating while it is slidably forced down the longitudinal bore of the substantially rigid cartridge body by, for example, the push-plate 10*a* of a conventional caulking gun 10 (FIG. 3). Although the example shown in FIG. 15 is for the side-by-side pouch embodiments described above in FIGS. 9-A and 10-A, a correspondingly similar plunger, with concentric annular lobes, would be used for the concentric pouch embodiment described above in FIG. 11-A.

FIGS. 16-A, 16-B and 16-C illustrate the plunger 119 of FIG. 15 with a substantially rigid cartridge body 126. Substantially rigid cartridge body 126 has a plunger opening 125, a nozzle end 128, and the rails 127*a* and 127*b*. Rails 127*a* and 127 can be integrally molded to run longitudinally from plunger opening 125 to an end opposite the plunger opening 125. Alternatively, rails 127*a* and 127*b* could be separate metal or plastic pieces. Also, rails 127*a* and 127*b* could be intermittent rails or continuous rails.

As shown in FIG. 16-A, when plunger 119 is to be inserted into the plunger opening 125, plunger 119 is arranged such that alignment grooves 120*a* and 120*b* engage rails 127*a* and 127*b*. It is apparent that in this illustration the leading face 122 of the plunger 119, with its dispensing lobes 123*a* and 123*b* (in FIG. 15), cannot be seen from this view angle, but it can be appreciated that the previously-described dispensing lobes 123*a* and 123*b* are generally aligned with the corresponding collapsible packages (not shown), which would already be positioned within the substantially rigid cartridge body 126.

FIG. 16-B shows the plunger 119 having been slidably inserted into the plunger opening 125 and partially slid down the bore of substantially rigid cartridge body 126. FIG. 16-C shows the plunger 119 further traveling down the bore of the substantially rigid cartridge body 126 toward the nozzle end 128 of the container, and is being kept in transverse positional alignment with the progressively collapsing packages ahead of it. Then, as the plunger 119 arrives at the nozzle end 128, the alignment of the dispensing lobes 123*a* and 123*b* (not shown in FIG. 16-C) facilitates ejecting the chemicals contained in the collapsible package(s).

To further facilitate ejection of the chemicals, the plunger 119 can have a tight interference fit within the substantially rigid cartridge body 126 from the plunger opening 125 to the nozzle end 128. However, a tight interference fit may inhibit the venting of any gas (usually air) trapped within the void regions between the inside surfaces of the main rigid cartridge body 126 and outer surfaces of the collapsible packages (not shown). While such a tight fit can aid in extending the shelf stability of the chemicals within the cartridge during storage or non-use, it can also lead to problems associated with vapor locking the plunger or pressurizing the trapped gas that may exist within the cartridge during dispensing. Pressure generated within the cartridge during dispensing, not only makes it difficult to dispense any chemicals, but could also cause chemicals to flow from the nozzle during pauses in or after completion of the dispensing operation.

Figure 17:
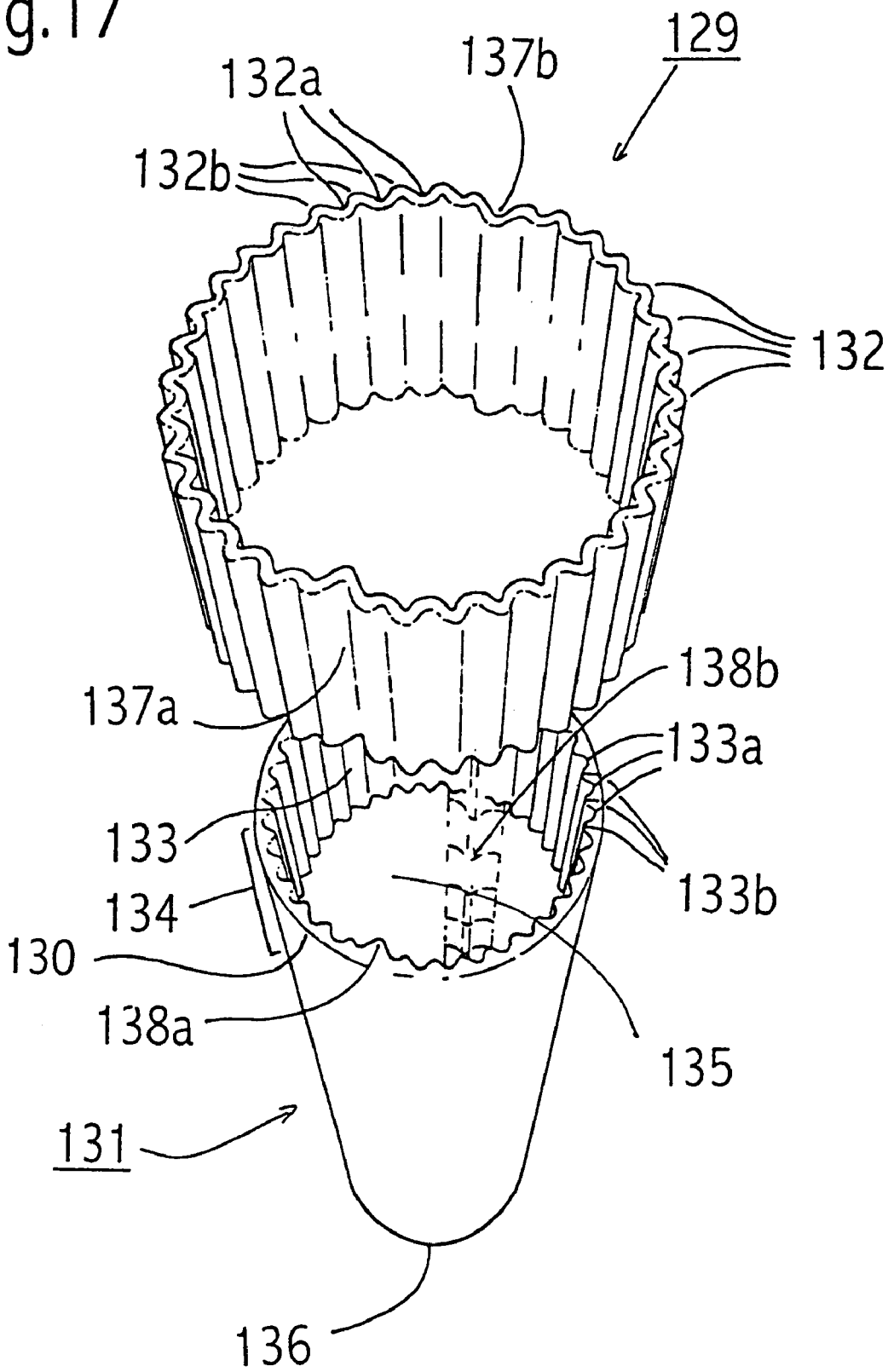
FIG. 17 shows another embodiment of a plunger in accordance with the present invention.

FIG. 17 shows another embodiment of a plunger 129 that can, optionally, incorporate the alignment grooves shown in the plunger 119 (FIG. 15). Plunger 129 includes a plurality of grooves, or ripples, 132 having a trough 132*a* and a peak 132*b*. Grooves 132 could be an undulating "V-shape," "U-shape," square, rounded, notched, or equivalent shapes. Also, while grooves 132 are shown to be uniformly shaped and placed on plunger 129, the actual groove shape placement is largely a matter or aesthetic design. In this example, grooves 137*a* and 137*b* are designated as alignment grooves as shown by their slightly larger "V-shape." The alignment grooves do not need to be larger than the other grooves, nor do they have to be the same shape as the other grooves.

Also shown in FIG. 17 is a substantially rigid cartridge body 131. Substantially rigid cartridge body 131 has an open end 130, a nozzle end 136, an upper inner surface 133 extending over a portion 134 of substantially rigid cartridge body 131 and a lower inner surface 135 below upper inner surface 133. Upper inner surface 133 has grooves, or ripples, having a trough 133*a* and a peak 133*b*. Generally, trough 132*a* and peak 132*b* correspond to trough 133*a* and peak 133*b*, such that when plunger 129 is inserted into the open end 130 of substantially rigid cartridge body 131, troughs 132*a* and peaks 132*b*, and troughs 133*a* and peaks 133*b* form an interference fit that assists in isolating the inside of substantially rigid cartridge body 131 from the outside environment. Generally, the portion 134 over which the inner surface 133 exists can be very small, such as from slightly greater than 0 inches, to very great, such as the full length of the inside of the substantially rigid cartridge body 131 (in this case, the lower inner surface 135 would not exist). However, ranges of about 0.10 inches to 1.50 inches are more useful. Lower inner surface 135 is generally, but not necessarily, smooth.

As shown in phantom, substantially rigid cartridge body 131 can have alignment rails 138*a* and 138*b*. Alignment rails 138*a* and 138*b* are used with alignment grooves 137*a* and 137*b* in a manner similar to the one described above. Further, plunger 129 could have the shape and lobes as the plunger 119 described above.

As will be shown more fully in describing FIGS. 18-A to 18-C, plunger 129 provides the added benefit of venting whatever trapped air might be inside the cartridge during the dispensing operation. Moreover, plunger 129 reduces the amount of force required by the user to overcome frictional resistance of the interference fit of the plunger within the main rigid cartridge body as the said plunger is driven down the bore of the said cartridge. Plunger 129 is adaptable to be used with any cartridge described herein.

Plunger 129 is shown in various stages of travel down the bore of substantially rigid cartridge body 131 in FIGS. 18-A to 18-C. FIG. 18-A shows plunger 129 just prior to insertion in substantially rigid cartridge body 131. FIG. 18-B shows plunger 129 just after insertion in substantially rigid cartridge body 131 with some travel down the bore. It becomes apparent, in FIG. 18-B, that after the plunger 129 is inserted into the open end 130 of substantially rigid cartridge body 131 the tight interference fit reduces gaseous fluid communication between the outside atmosphere and the interior of the cartridge. The reduction in gaseous fluid communication helps to further provide protection for the chemicals within the dispensing cartridge. Then, as shown in FIG. 18-C, as the plunger 129 is slid past the upper inner surface 133 to lower inner surface 135 of the interior of the substantially rigid cartridge body 131, with only the plunger ripple peaks 132*b* coming into frictional contact with the lower inner surface 135, then the grooves 132 provide a means of gaseous fluid communication between the interior of the substantially rigid cartridge body 131 and the outside atmosphere, thus relieving any undesirable air pressure that might develop during the emptying of the pouches within the cartridge. By relieving said air pressure, it is then possible to minimize or eliminate the possibility that pressurized air within the main rigid cartridge body, developed during dispensing, could lead to undesirable after-flow of the sealant or adhesive from the nozzle during pauses in the dispensing operation. Second, by contacting the lower inner surface 135 of the substantially rigid cartridge body 131 with only the plunger ripple peaks 132*b*, the total contact surface area is reduced. Because the contact area between the two said surfaces is reduced, it can be appreciated that the total force required to overcome the frictional resistance is reduced also. Thus, making it easier for the user to dispense the product.

FIG. 19-A shows another embodiment of a plunger 139. Plunger 139 is designed to be used with a correspondingly designed substantially rigid cartridge body 140, as shown in FIG. 19-B. Substantially rigid cartridge body 140 has an upper inner surface 141*a* and a lower inner surface 141*b* (Note: For clarity, FIG. 19-B shows a cross sectional view of a cartridge without any pouches being present). Plunger 139 includes a leading face 142, perimeter ribs 143, a rear edge 144, protrusions 145, and alignment grooves 146*a* and 146*b*.

In this example, the leading face 142 of the plunger 139 is uniformly concave in shape, which is one of many suitable shapes for the 1-component version of the present invention. The concavity of the plunger leading face 142 helps to fold the collapsible film of the pouch away from the wall of the cartridge and direct it toward the center of the plunger face and away from the edge of the plunger face, thus minimizing the possibility of pinching the pouch film between the edge of the plunger and the wall of the cartridge. Perimeter ribs 143, which are for convenience shown equally shaped and placed around the circumference of the plunger, are, in a longitudinal direction, flush with rear edge 144 of the plunger, but have protrusions 145 that extend slightly beyond the plunger leading face 142. Also shown in this view of the plunger 139 are the optional V-shaped alignment grooves 146*a* and 146*b* (shown larger for convenience), which operate in a manner described above in other embodiments of the present invention.

Upper inner surface 141*a* and lower inner surface 141*b* are described with transverse sectional views taken along the substantially rigid cartridge body 140 at A–A' and B–B' in FIG. 19-B, as shown in FIG. 19-C1 and FIG. 19-C2 and FIGS. 19-D1 and 19-D2, respectively.

As shown in FIGS. 19-C1 and 19-C2, the shape of both the interior surface of the cartridge in the upper inner surface 141*a* of said cartridge body and the shape of the plunger 139 can be seen in their frictional-fit orientation to one another. The gray shaded area is a transverse cross-sectional view of the plunger 139, while the unshaded area is a transverse cross-sectional view of the 141*a* region of the cartridge body 140. The ribs 143 of the plunger fit tightly into the corresponding grooves 147 of the upper inner surface 141*a* of the said cartridge body. From this view, it can be appreciated that the plunger 139 slidably fits into the upper inner surface 141*a* the substantially rigid cartridge body 140 tightly in order to provide a barrier to gaseous fluid communication between the outside atmosphere and the interior of the cartridge body.

Then, if a transverse view is taken of substantially rigid cartridge body 140 at B–B' in FIG. 19-B, as shown in FIG. 19-D1 and FIG. 19-D2, the shape of both the lower inner surface 141*b* of the substantially rigid cartridge body 140 and the shape of the plunger 139 can be seen in orientation to one another. The gray shaded area is a transverse cross-sectional view of the plunger 139, and the unshaded area is a transverse cross-sectional view of the lower inner surface 141*b*. From this view, it can be seen that the rectangular grooves 148 of the lower inner surface 141*b* are designed so that an interference fit does not exist between grooves 148 and ribs 143. Consequently, channels 149 develop around the ribs 143 as the plunger is slidably moved from upper inner surface 141*a* to lower inner surface 141*b* during dispensing by the user. With the channels providing a means of fluid communication between the interior or the substantially rigid cartridge body 140 and the environment. The fluid communication allows the escape of any trapped and pressurized air within the cartridge during dispensing, and the possibility of unwanted product after-flow from the nozzle during pauses in use is greatly reduced or eliminated.

Moreover, some additional advantages can be appreciated from the interaction of plunger 139 and cartridge body 140. First, as the said plunger travels from upper inner surface 141*a* to lower inner surface 141*b* the total surface contact area between the plunger and the cartridge interior is reduced, thus reducing the force required by the user to cause the plunger to slidably move down the bore of the cartridge. Second, because the peaks 150 of the ribs 143 and the protrusions 145 of the plunger 139 contact the bottoms 148*a* of the rectangular grooves 148 of the lower inner surface 141*b* of the substantially rigid cartridge body, it can be seen that the protrusions 145 can slide underneath the collapsible packages, which lie against the tops 148*b* of the rectangular grooves of the inside wall of the cartridge, during travel down the bore of the cartridge to gather it up, collapse it like an accordion, and avoid it being pinched between the said plunger and said cartridge body. Also, the protrusions 145 can act as a mechanical stop for the plunger 139 when it reaches the bottom or nozzle end of substantially rigid cartridge body 140.

In FIG. 20-A and FIG. 20-B (which would be cross-sectional views of the lower inner surface of a substantially rigid cartridge body similar to the cross-sectional views of the lower inner surface 141*b* of the cartridge body 140 in FIGS. 19-D1 and 19-D2), the position of the collapsible package 153 (in this representative case, twin side-by-side pouches 152*a* and 152*b*) is shown with respect to the rectangular grooves 148 described in FIG. 19-D1 and FIG. 19-D2. It can be appreciated from these illustrations that because the collapsible package 153 does not touch the bottoms 148*a* of the grooves 148, the protrusions 145 of the plunger 139 (of FIG. 19-C) that do slidably contact the bottoms of the rectangular grooves, can readily slide underneath the said collapsible film and scoop it up to avoid it being pinched between the said plunger and said cartridge wall.

Figure 21:
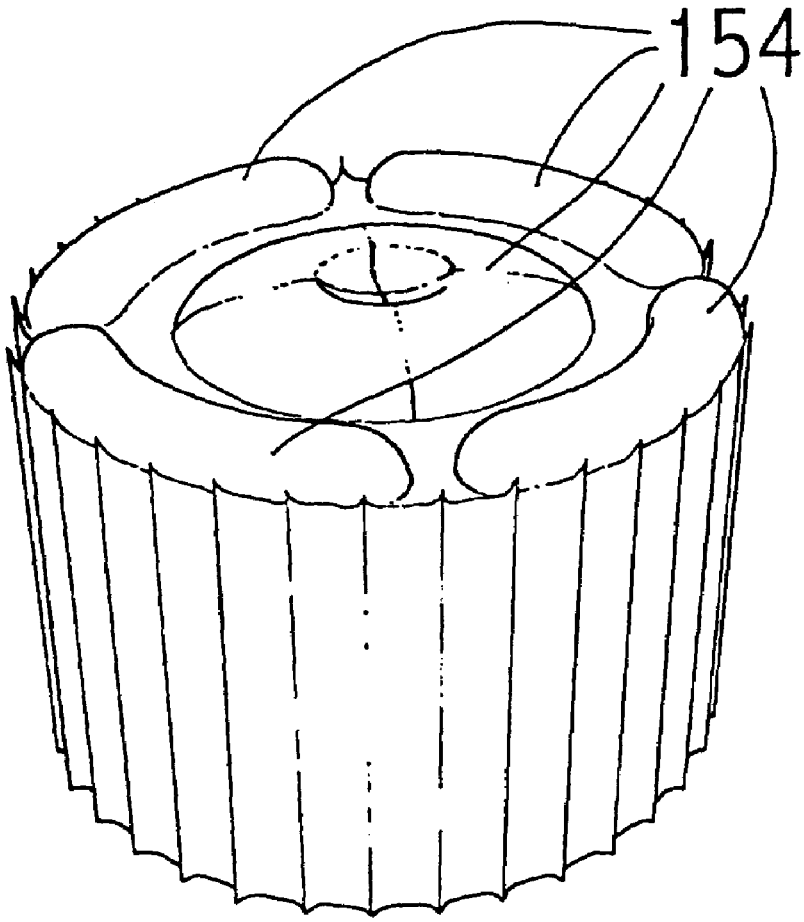
FIG. 21 shows still another embodiment of a plunger in accordance with the present invention.

FIG. 21 shows a perspective view of a plunger that incorporates the rib feature of FIG. 19-A with the concentric lobe feature as described in the text concerning FIG. 15, which would be appropriate for use in the embodiment shown in, for example, FIG. 11-A. In this example, the five dispensing lobes 154 illustrate how such lobes are to be configured for the best ejection possible of chemicals from a concentric inner and outer collapsible package design as described in FIG. 11-A. It can be appreciated that all the plungers can be used with various embodiments of the cartridge.

FIGS. 22-A, 22-B and 22-C show, in sequence, another embodiment of the present invention capable of venting the inside of substantially rigid cartridge body 156 to the environment. In particular, a sidewall 155 of the substantially rigid cartridge body 156 has one or more vent passageways, or holes, 157 that can provide a means of gaseous fluid communication between the outside atmosphere and the interior regions of the cartridge. In FIG. 22-A the holes 157 can be seen covered by a transparent strip of adhesive sealing tape 158. Other devices can reduce fluid communication trough holes 157. These other device could be, for example, metal bands, plastic or metal plugs or caps, elastic bands, etc. Tape 158 seals holes 157 to assist in protecting the chemicals internal to the cartridge from the atmosphere. In FIG. 22-B the sealing tape 158 is shown being removed from the sidewall 155 and uncovering holes 157. Typically, hole 157 would be uncovered just before a dispensing nozzle (not shown) is attached to the nub 159 and is placed into a common caulking gun, such as gun 10 (FIG. 3). FIG. 22-C shows complete removal of tape 158 exposing holes 157 to fully provide their venting function as the plunger (not shown) is slidably driven down the interior bore of the cartridge body 156. The sealing tape 158, of course, can be opaque (rather than transparent, as shown) and can be composed of different materials, such as aluminum-foil laminated with plastic film, in order to achieve appropriate levels of barrier properties. Also, the said vent holes, which can number from one to ten, or more, can be located in different positions along the length and circumference of the said cartridge body to equal effect. For example, one hole 157 could be located towards the nozzle as shown, one hole 157 could be located towards the middle of the cartridge, and one hole 157 could be located towards the plunger end of the cartridge. Further, the tape 158 (or other sealing device) could be re-attachable to facilitate partial dispensing of the chemicals.

While the invention has been particularly shown and described with reference to some embodiments thereof, it will be understood by those skilled in the art that various other changes in the form and details may be made without departing from the spirit and scope of the invention.

We claim:

1. A method of filling collapsible packages to be used in a caulking gun, the method comprising the steps of:

securing at least one collapsible package to an inlet of a cartridge body;

applying pressure to an interior of the at least one collapsible package so that the pressure in the at least one collapsible package is greater than a pressure in the cartridge body such that the pressure causes the at least one collapsible package to extend;

reducing pressure in the cartridge body;

removing the pressure being applied to the interior of the at least one collapsible package so that the pressure in the cartridge body is less than the pressure in the interior of the at least one collapsible package such that the reduced pressure maintains the at least one collapsible package extended;

filling the cartridge body with at least one chemical; and increasing the pressure in the at least one collapsible package, such that the at least one collapsible package is filled.

2. The method of claim 1, further comprising:

establishing an ambient pressure in the cartridge body and the interior of the at least one collapsible package such that applying pressure to the interior of the at least one collapsible package causes the interior of the at least one collapsible package to be at a pressure greater than ambient;

reducing pressure in the cartridge body reduces pressure such that the cartridge body pressure is less than ambient;

removing the pressure being applied restores the interior to ambient; and increasing pressure in the cartridge body increases pressure back to ambient.

3. The method of claim 2, wherein the reducing pressure reduces pressure to a vacuum.

4. The method of claim 3, wherein the vacuum is drawn to at least 10 inches of mercury.

5. The method of claim 4, wherein the vacuum is drawn to at least 20 inches of mercury.

6. The method of claim 1, further comprising the steps of:

attaching a gas-emitting fixture to the inlet of the cartridge body; and coupling a gaseous pressure pump to the fixture.

7. The method of claim 6, wherein the gaseous pressure is applied by compressed air.

8. The method of claim 1, further comprising the steps of:

attaching a gas-emitting fixture to the inlet of the cartridge body and coupling a gaseous pressure pump to the fixture prior to applying pressure to the interior of the at least one collapsible package;

attaching a vacuum fixture to a plunger end of the cartridge body;

coupling a vacuum pump to the vacuum fixture prior to reducing pressure in the cartridge body; and removing the gas emitting fixture subsequent to removing the pressure being applied to the interior of the at least one collapsible package.

9. The method of claim 1, wherein applying pressure to the interior of the at least one collapsible package causes the interior of the at least one collapsible package to fully expand an remove any wrinkles in the at least one collapsible package.

10. The method of claim 9, wherein reducing pressure in the cartridge body reduces pressure such that when the pressure to the interior is removed the at least one collapsible package maintains fully expansion.

11. The method of claim 1, further comprising the steps of:

attaching a vacuum fixture to a plunger end of the cartridge body; and coupling a vacuum pump to the vacuum fixture.

12. The method of claim 11, further comprising the step of:

replacing the vacuum fixture with a plunger fixture after the at least one collapsible package is filled.

13. The method of claim 1, further comprising the steps of:

inserting at least one filling nozzle into the at least one collapsible package prior to filling the at least one collapsible package; and removing the at least one filling nozzle from the at least one collapsible package after the at least one collapsible package is filled.

14. The method of claim 1, further comprising the steps of:

inserting at least one filling nozzle into the at least one collapsible package prior to filling the at least one collapsible package; and removing the at least one filling nozzle during the filling step so the at least one filling nozzle fills the at least one collapsible package as the at least on filling nozzle is removed form the at least one collapsible package.

15. The method of claim 1, further comprising the step of:

sealing the inlet of the cartridge body at least one of prior to or after restoring the pressure in the cartridge body.

* * * * *